US008294657B2

(12) United States Patent
Kim et al.

(10) Patent No.: US 8,294,657 B2
(45) Date of Patent: Oct. 23, 2012

(54) LIQUID CRYSTAL DISPLAY, DRIVING APPARATUS, DIGITAL-ANALOG CONVERTER AND OUTPUT VOLTAGE AMPLIFIER THEREOF

(75) Inventors: Byung-Doo Kim, Yongin-si (KR); Hee-Jong Park, Yongin-si (KR); Ju-Young No, Cheongju-si (KR); Sang-Hoon Lee, Uiwang-si (KR)

(73) Assignee: MC Technology, Co., Ltd., Suwon-Si (KR)

( * ) Notice: Subject to any disclaimer, the term of this patent is extended or adjusted under 35 U.S.C. 154(b) by 316 days.

(21) Appl. No.: 12/452,341

(22) PCT Filed: Jun. 24, 2008

(86) PCT No.: PCT/KR2008/003596

§ 371 (c)(1),
(2), (4) Date: Dec. 24, 2009

(87) PCT Pub. No.: WO2009/002079

PCT Pub. Date: Dec. 31, 2008

(65) Prior Publication Data

US 2010/0134528 A1 Jun. 3, 2010

(30) Foreign Application Priority Data

Jun. 27, 2007 (KR) ..... 10-2007-0063709

(51) Int. Cl.
*G09G 3/36* (2006.01)

(52) U.S. Cl. ..... 345/100; 345/690

(58) Field of Classification Search ..... 345/690, 345/204, 87–104

See application file for complete search history.

(56) References Cited

U.S. PATENT DOCUMENTS

| | | | | |
|---|---|---|---|---|
| 6,535,189 | B1 | 3/2003 | Akiyama et al. | |
| 2005/0140630 | A1 | 6/2005 | Kikuchi et al. | |
| 2005/0212739 | A1 | 9/2005 | Kawakami | |
| 2005/0219181 | A1 * | 10/2005 | Matsuda | 345/89 |
| 2006/0092119 | A1 | 5/2006 | Kim et al. | |

FOREIGN PATENT DOCUMENTS

| | | |
|---|---|---|
| KR | 1020050049354 | 5/2005 |
| KR | 1020060037566 | 5/2006 |

* cited by examiner

*Primary Examiner* — Stephen Sherman
(74) *Attorney, Agent, or Firm* — Lexyoume IP Meister, PLLC.

(57) ABSTRACT

The present invention relates to a liquid crystal display, a driving device thereof, a digital to analog converter, and an output voltage amplifying circuit. The present invention provides a liquid crystal display driving device including a reference gray voltage generator for generating a plurality of reference gray voltages, and a data driver for generating a plurality of gray voltages based on the plurality of reference gray voltages and applying a data signal that is generated by selecting a gray voltage corresponding to m-bit video signals applied from the outside from among the plurality of gray voltages to the pixel The data driver includes: a voltage generator for selecting a first gray voltage and a second gray voltage corresponding to bit values of (m−k) bits from among the video signal from among the plurality of gray voltages, and outputting the first and second gray voltages; an output voltage generator for outputting 2k voltages determined as one of the first and second gray voltages corresponding to bit values of k bits from among the video signal; and an output voltage amplifier for generating the data signal by combining the 2k voltages, and applying the data signal to a plurality of pixels. According to the present invention, a liquid crystal display having a small cost and area can be realized.

33 Claims, 19 Drawing Sheets

LIQUID CRYSTAL DISPLAY, DRIVING APPARATUS, DIGITAL-ANALOG CONVERTER AND OUTPUT VOLTAGE AMPLIFIER THEREOF

BACKGROUND OF THE INVENTION (a) Field of the Invention

The present invention relates to a liquid crystal display (LCD), a driving device thereof, a digital to analog (D/A) converter, and an output voltage amplifying circuit.

(b) Description of the Related Art

Recently, as personal computers and televisions have been become lighter and slimmer, display devices have also been required to become lighter and slimmer, and flat displays such as liquid crystal displays (LCD) other than cathode ray tubes (CRT) have been increasingly researched according to the requirements.

The liquid crystal display (LCD) is a display device for acquiring a desired video signal by applying an electric field to a liquid crystal material having an anisotropic dielectric constant and injected between two substrates, controlling the intensity of the electric field, and controlling the light transmitted to the substrates from an external light source (a back light).

The liquid crystal display (LCD) is representative of the portable flat panel displays, and a thin film transistor liquid crystal display (TFT-LCD) using a thin film transistor (TFT) as a switch is mainly used.

In general, the liquid crystal display (LCD) uses a decoder for outputting a voltage corresponding to input digital data in order to select a gray voltage corresponding to a grayscale to be displayed through a pixel of a liquid crystal display (LCD) panel from among a plurality of gray voltages generated based on a reference gray voltage.

FIG. 1 shows a brief general decoder for outputting a voltage corresponding to 10-bit input digital data.

As shown in FIG. 1, a general decoder for outputting a voltage corresponding to 10-bit input digital data includes 2046 ($=2^{11}-2=2^{10}+2^9+2^8+2^7+2^6+2^5+2^4+2^3+2^2+2^1$) switches. When the digital data are increased by one bit, the decoder must include 4094 ($=2^{12}-2$) switches. The increased number of switches included in the decoder corresponding to the bit number of digital data increases the cost of realizing the liquid crystal display (LCD) and the area of realizing the liquid crystal display (LCD).

Korean Patent No. 10-0336683 discloses a skill for reducing the switches included in the conventional decoder. Korean Patent No. 10-0336683 changes the structure of an output amplifier for outputting a gray voltage to combine the voltages and outputs all voltages corresponding to the input digital data rather than reducing the number of switches included in the decoder, which will be described with reference to FIG. 2.

FIG. 2 shows a conventional output amplifier structure.

The output amplifier according to Korean Patent No. 10-0336683 shown in FIG. 2 includes input transistors (S1, S2, S3, S4) driven by a plurality of voltages (Va, Vb, Vc, Vd) output by the decoder and coupled in parallel to form a first input terminal, and input transistors (S1', S2', S3', S4') driven by a feedback signal (Vx) corresponding to an output voltage (Vout) and coupled in parallel to form a second input terminal. One terminal of each input transistor (S1, S2, S3, S4) forming the first input terminal and each input transistor (S1', S2', S3', S4') forming the second input terminal is coupled to a single node (Na), and the node (Na) is coupled to the power source (VSS) for supplying the VSS voltage through a constant current source (Ix).

However, the output amplifier shown in FIG. 2 cannot accurately reflect the voltage difference of a plurality of voltages (Va, Vb, Vc, Vd), and hence, a supplementing method is required.

SUMMARY OF THE INVENTION

The present invention has been made in an effort to provide a liquid crystal display (LCD) for reducing a realization cost and area of the LCD, a driving device thereof, a digital to analog (D/A) converter, and an output voltage amplifying circuit.

An exemplary embodiment of the present invention provides a liquid crystal display including: a liquid crystal display panel including a plurality of scan lines for transmitting a plurality of scan signals, a plurality of data lines for transmitting a plurality of data signals, and a plurality of pixels defined by the plurality of scan lines and the plurality of data lines; a reference gray voltage generator for generating a plurality of reference gray voltages; and a data driver for generating the plurality of data signals by combining $2^k$ voltages that correspond to bit values of (m−k) bits from among m-bit video signals applied from the outside based on the plurality of reference gray voltages and are determined as one of a first gray voltage and a second gray voltage, and applying the plurality of data signals to the plurality of pixels, wherein the data driver includes a digital to analog (D/A) converter including a first decoder to a third decoder, generating a third gray voltage to a fifth gray voltage respectively corresponding to bit values of bits less than (m−k−2) bits from among the (m−k) bits by using the first to third decoders, and generating the first and second gray voltages by selecting two voltages from among the third to fifth gray voltages, where m is a natural number equal to or greater than 3, and k is a natural number less than (m−2).

Another embodiment of the present invention provides a liquid crystal display including: a liquid crystal display panel including a plurality of scan lines for transmitting a plurality of scan signals, a plurality of data lines for transmitting a plurality of data signals, and a plurality of pixels defined by the plurality of scan lines and the plurality of data lines; a reference gray voltage generator for generating a plurality of reference gray voltages; and a data driver for applying the plurality of data signals to the plurality of pixels, the data signals corresponding to a third gray voltage that is generated in correspondence to bit values of n bits from among the plurality of data signals or the video signal generated by combining $2^k$ voltages that correspond to bit values of (m−k) bits from among m-bit video signals applied from the outside based on the plurality of reference gray voltages and are determined to be one of a first gray voltage and a second gray voltage, wherein the data driver includes a digital to analog (D/A) converter for generating the first and second gray voltages or generating the third gray voltage by selecting two voltages from among fourth to sixth gray voltages that are generated corresponding to bit values of bits less than (m−k−2) bits from among the (m−k) bits, where m is a natural number equal to or greater than 3, k is a natural number less than m−2, and n is a natural number greater than or equal to 2 and less than m.

Yet another embodiment of the present invention provides a liquid crystal display driving device including: a reference gray voltage generator for generating a plurality of reference gray voltages; and a data driver for generating a plurality of gray voltages based on the plurality of reference gray voltages, and applying a data signal that is generated by selecting a gray voltage corresponding to m-bit video signals applied from the outside from among the plurality of gray voltages to the pixel. The data driver includes: a voltage generator for selecting a first gray voltage and a second gray voltage corresponding to bit values of (m−k) bits from among the video signal from among the plurality of gray voltages, and outputting the first and second gray voltages; an output voltage generator for outputting $2^k$ voltages determined as one of the first and second gray voltages corresponding to bit values of k bits from among the video signal; and an output voltage amplifier for generating the data signal by combining the $2^k$ voltages, and applying the data signal to a plurality of pixels, where m is a natural number equal to or greater than 3 and k is a natural number less than m−2.

According to an embodiment of the present invention, a driving device of a liquid crystal display includes: a reference gray voltage generator for generating a plurality of reference gray voltages; and a data driver for generating a plurality of gray voltages based on the plurality of reference gray voltages, and applying a data signal that is generated by selecting a gray voltage corresponding to m-bit video signals applied from the outside from among the plurality of gray voltages to the pixel. The data driver includes: a voltage generator for selecting a first gray voltage and a second gray voltage corresponding to bit values of (m−k) bits from among the video signal from among the plurality of gray voltages, and outputting the first and second gray voltages; an output voltage generator for outputting $2^k$ voltages determined as one of the first and second gray voltages corresponding to bit values of k bits from among the video signal; at least one decoder for generating a third gray voltage corresponding to bit values of at least 2 bits from among the video signal; and an output voltage amplifier for generating the data signal by combining the $2^k$ voltages, or generating the data signal corresponding to the third gray voltage, and applying the data signal to a plurality of pixels, where m is a natural number equal to or greater than 3, and k is a natural number less than (m−2).

According to an embodiment of the present invention, a digital to analog converter for generating a plurality of gray voltages based on a plurality of reference gray voltages, and selecting and outputting a gray voltage corresponding to a digital video signal applied from the outside from among the plurality of gray voltages, includes: a voltage generator for selecting and outputting a first gray voltage and a second gray voltage corresponding to bit values of m−k bits except k bits from among the m-bit digital video signal; and an output voltage generator for outputting $2^k$ voltages determined as one of the first and second gray voltages corresponding to bit values of the k bits from among the digital video signal, where m is a natural number equal to or greater than 3 and k is a natural number less than m−2.

According to an embodiment of the present invention, an output voltage amplifying circuit for receiving a gray voltage corresponding to a video signal, generating a data signal corresponding to the gray voltage, and applying the same to a pixel of a liquid crystal display includes: a plurality of first switches turned on/off by a gray voltage corresponding to the video signal; a plurality of second switches turned on/off by the data signal, and respectively having one terminal, one terminal of the second switch and a corresponding one terminal of the first switch sharing a node; a plurality of current sources coupled between a plurality of the nodes and a first power source for supplying a first voltage; and an output terminal coupled to other terminals of the plurality of second switches, and outputting the data signal that is generated by combining the plurality of gray voltages to the pixel.

According to the present invention, cost and area for realizing the liquid crystal display (LCD) can be reduced by reducing the number of switches included in the data driver.

DETAILED DESCRIPTION OF THE EMBODIMENTS

Figure 1:
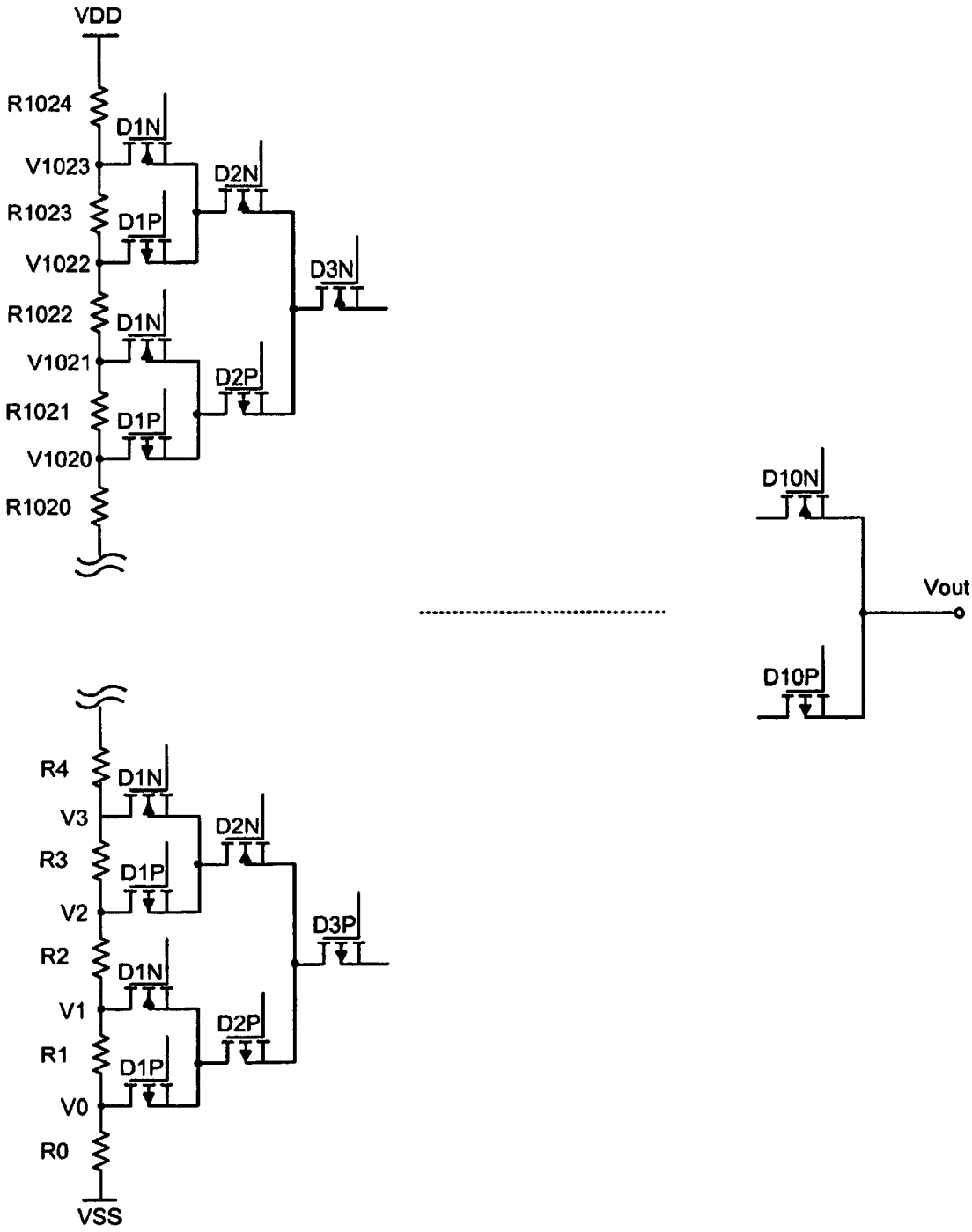
FIG. 1 shows a brief general decoder for outputting a voltage corresponding to 10-bit input digital data.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

A liquid crystal display (LCD), a driving device thereof, a digital to analog (D/A) converter, and an output voltage amplifying circuit according to exemplary embodiments of the present invention will now be described with reference to accompanying drawings.

Figure 3:
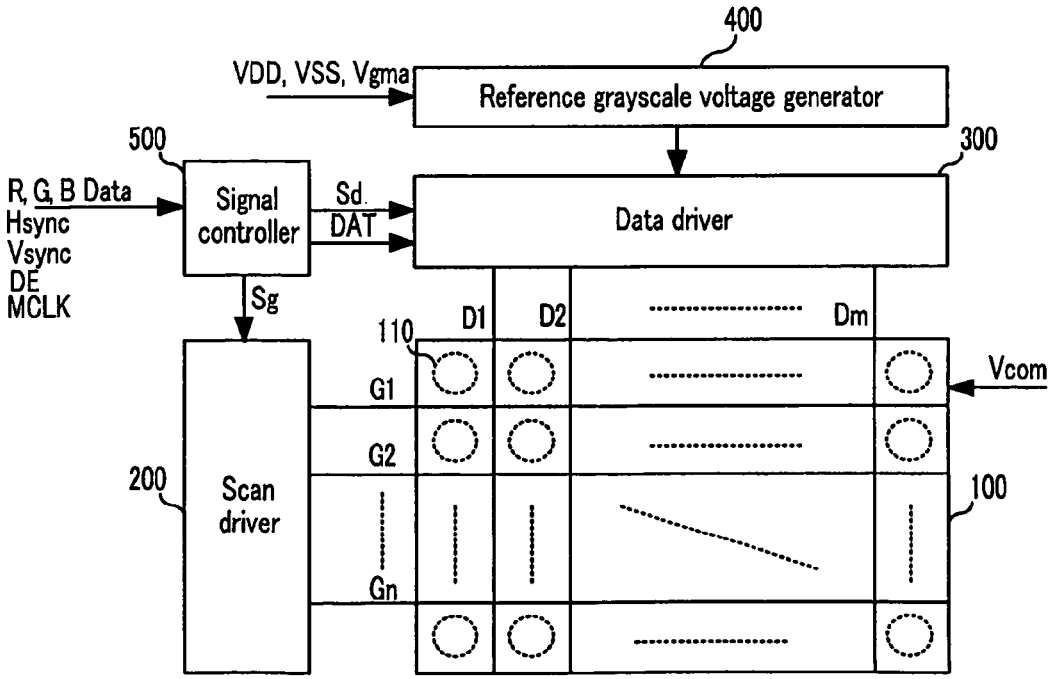
FIG. 3 shows a liquid crystal display (LCD) according to an exemplary embodiment of the present invention.

FIG. 3 shows a liquid crystal display (LCD) according to an exemplary embodiment of the present invention.

As shown in FIG. 3, the liquid crystal display (LCD) includes a liquid crystal display (LCD) panel 100, a scan driver 200, a data driver 300, a reference grayscale voltage generator 400, and a signal controller 500.

A plurality of scan lines ($G_1$-$G_n$) for transmitting scan on signals applied by the scan driver 200 are formed on the liquid crystal display (LCD) panel 100, and data lines D1-Dm being insulated to cross the scan lines and transmitting a grayscale data voltage corresponding to grayscale data are formed thereon. A plurality of pixels 110 arranged in a matrix format are surrounded by the scan lines and the data lines, and each changes the transmittance of light scanned by a back light (not shown) according to the signal that is input through a scan line and a data line, which will now be described with reference to FIG. 4.

Figure 4:
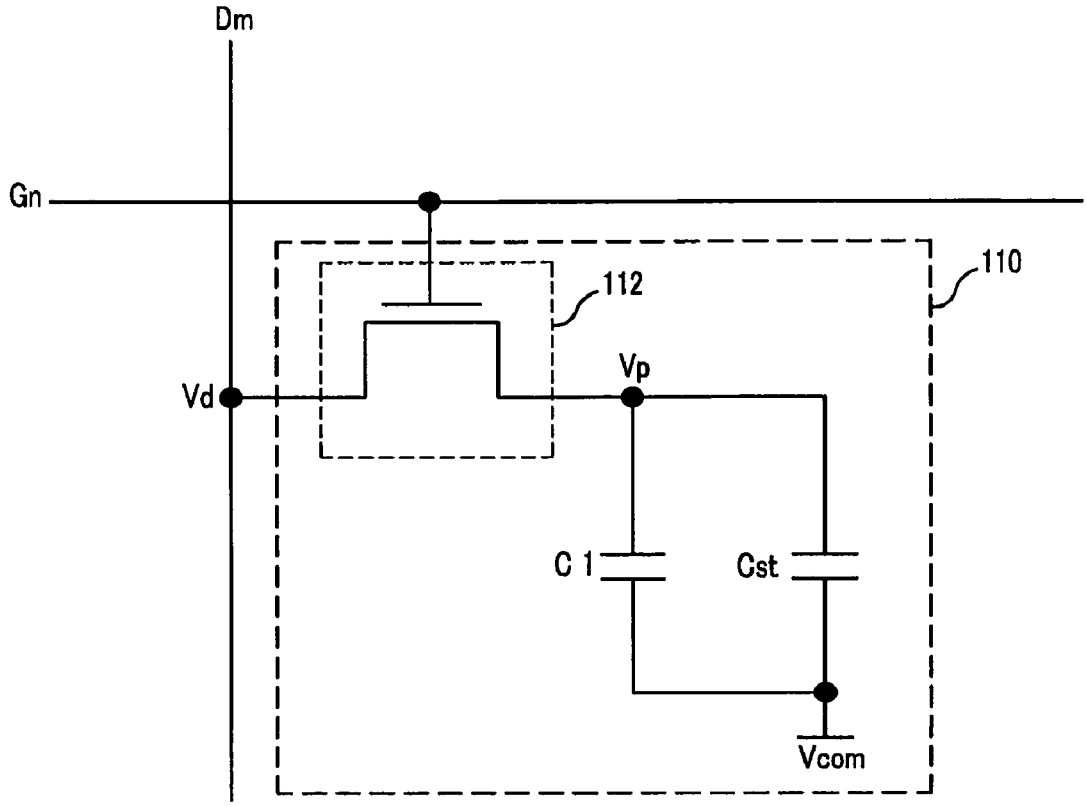
FIG. 4 shows an equivalent circuit of a pixel 110 of a liquid crystal display (LCD) according to an exemplary embodiment of the present invention.

FIG. 4 shows an equivalent circuit of a pixel 110 of a liquid crystal display (LCD) according to an exemplary embodiment of the present invention.

As shown in FIG. 4, the pixel 110 of the liquid crystal display (LCD) includes a TFT 112, a liquid crystal capacitor C1, and a storage capacitor Cst. For reference, the data line Dm represents a random data line from among the data lines D1-Dm, and the scan line Gn represents a random scan line from among the scan lines $G_1$-$G_n$.

The TFT 112 has a source electrode coupled to the data line Dm and a gate electrode coupled to the scan line Gn. The liquid crystal capacitor C1 is coupled between a drain electrode of the TFT 112 and a common voltage Vcom. The storage capacitor Cst is coupled in parallel with the liquid crystal capacitor C1.

In FIG. 4, when a scan signal is applied to the scan line Gn to turn on the TFT 112, the data voltage Vd supplied to the data line Dm is applied to a pixel electrode (not shown) through the TFT 112. An electric field corresponding to a difference between a pixel voltage Vp applied to the pixel electrode and the common voltage Vcom is applied to liquid crystal (equivalently shown as a liquid crystal capacitor C1 in FIG. 4) so that the light may be transmitted according to the transmittance corresponding to the intensity of the electric field. In this instance, the pixel voltage Vp is to be maintained for 1 frame or 1 field, and the storage capacitor Cst of FIG. 4 is used in an auxiliary manner so as to maintain the pixel voltage Vp applied to the pixel electrode.

The scan driver 200 is coupled to the scan lines $G_1$-$G_n$ of the liquid crystal display (LCD) panel 100 to apply the scan signal generated by combining a gate on voltage Von and a gate off voltage Voff to the scan lines $G_1$-$G_n$. In detail, the scan driver 200 sequentially applies the gate on voltage Von to the scan lines $G_1$-$G_n$ to turn on the TFT having a gate electrode coupled to the scan line to which the gate on voltage Von is applied.

The data driver 300 includes a plurality of data driving integrated circuits (not shown) coupled to the signal controller 500 and the reference grayscale voltage generator 400. Each data driving integrated circuit is coupled to the corresponding data line from among the data lines D1-Dm of the liquid crystal display (LCD) panel 100, generates a plurality of gray voltages based on the reference gray voltage input by the reference grayscale voltage generator 400, selects a corresponding gray voltage from among the gray voltages, and applies it to the data lines D1-Dm coupled as a data signal.

The reference grayscale voltage generator 400 generates two reference gray voltages relating to the transmittance of the pixel 110 by using a plurality of voltages VDD, VSS, and Vgma input by a power source voltage supply (not shown). One of them has a positive value Vcom~VDD for the common voltage Vcom and the other one has a negative value Vcom~Vss. Also, the reference grayscale voltage generator 400 additionally generates a voltage VP(−1) or VP$2^m$ and a voltage VN(−1) or VN$2^m$ in addition to the reference gray voltages. Here, the voltage Vgma is a random voltage between the voltage VSS and the voltage VDD. The voltages VP(−1), VN(−1), VP$2^m$, and VN$2^m$ will be described later.

The signal controller 500 receives grayscale data signals (RGB data) and input control signals for controlling displays of the grayscale data signals from the outside or a graphics controller (not shown). Examples of the input control signals include a horizontal synchronization signal Hsync, a vertical synchronization signal Vsync, a data enable signal DE, and a main clock signal MCLK. Here, the data enable signal DE is a signal for indicating application of data, and the main clock signal MCLK provided by a microprocessor (not shown) is used as a reference signal.

The signal controller 500 processes the grayscale data signal (RGB Data) according to the operational condition of the LCD panel 100 to generate a gate control signal Sg, a data control signal Sd, and a digital video signal DAT. The signal controller 500 transmits the gate control signal Sg to the scan driver 200, and supplies the data control signal Sd and the digital video signal DAT to the data driver 300 to thus control the scan driver 200 and the data driver 300.

The gate control signal Sg includes at least one clock signal for controlling an output period of a scan start signal STV for ordering a scan start and a gate on voltage Von. The gate control signal Sg may further include an output enable signal OE for controlling the maintenance time of the gate on voltage Von.

The data control signal Sd includes a horizontal sync start signal STH for indicating a transmission start of a video signal for the pixel 110 of one row, a load signal LOAD for applying a data signal to the data lines D1-Dm, and a data clock signal HCLK. The data control signal Sd may further include an inversion signal RVS for inverting the voltage polarity of a data signal for the common voltage Vcom (hereinafter, the voltage polarity of a data signal for the common voltage will be called a polarity of a data signal). Also, the data control signal Sd may further include a plurality of signals SEL0, SEL1, and SHL for controlling an operation of the data driver 300.

According to the data control signal Sd provided by the signal controller 500, the data driving integrated circuit of the data driver 300 receives a digital video signal DAT for the pixel 110 for one row, generates a plurality of gray voltages based on the reference gray voltage of the reference grayscale voltage generator 400, selects a gray voltage corresponding to the digital video signal DAT from among the gray voltages to convert the digital video signal DAT into an analog data signal, and applies the analog data signal to the corresponding data lines D1-Dm.

The scan driver 200 applies the gate on voltage Von to the scan lines $G_1$-$G_n$ according to the gate control signal Sg provided by the signal controller 500 to turn on the switch coupled to the scan lines $G_1$-$G_n$. Then, the data signal applied to the data lines D1-Dm is applied to the corresponding pixel 110 through the turned on switch.

A difference between the voltage of the data signal applied to the pixel 110 and the common voltage Vcom is shown as a charged voltage at the liquid crystal capacitor C1, that is, the pixel voltage Vp. The liquid crystal molecules are differently arranged by the pixel voltage Vp to thus change the polarization of light transmitting the liquid crystal layer. The change of polarization is shown as the change of transmittance of light by a polarizer attached on the LCD panel 100.

By repeating the above-noted process for each 1 horizontal period (which is also written as 1H and corresponds to one period of the horizontal synchronization signal Hsync and the data enable signal DE), the gate on voltage Von is sequentially applied to all the gate lines $G_1$-$G_n$) to apply the data signal to all the pixels 100 and display an image corresponding to one frame.

When a frame is finished, another frame starts, and the state of the inversion signal RVS applied to the data driver 300 is controlled so that the polarity of the data signal applied to the pixel 110 may be inverted from the previous frame (called frame inversion). In this instance, the polarity of the data signal flowing through one data line can be changed (e.g., row inversion or dot inversion) or the polarities of the data signals applied to one pixel row can be different (e.g., column inversion or dot inversion) according to the characteristic of the inversion signal RVS in one frame.

The data driver 300 according to an exemplary embodiment of the present invention will now be described with reference to FIG. 5.

Figure 5:
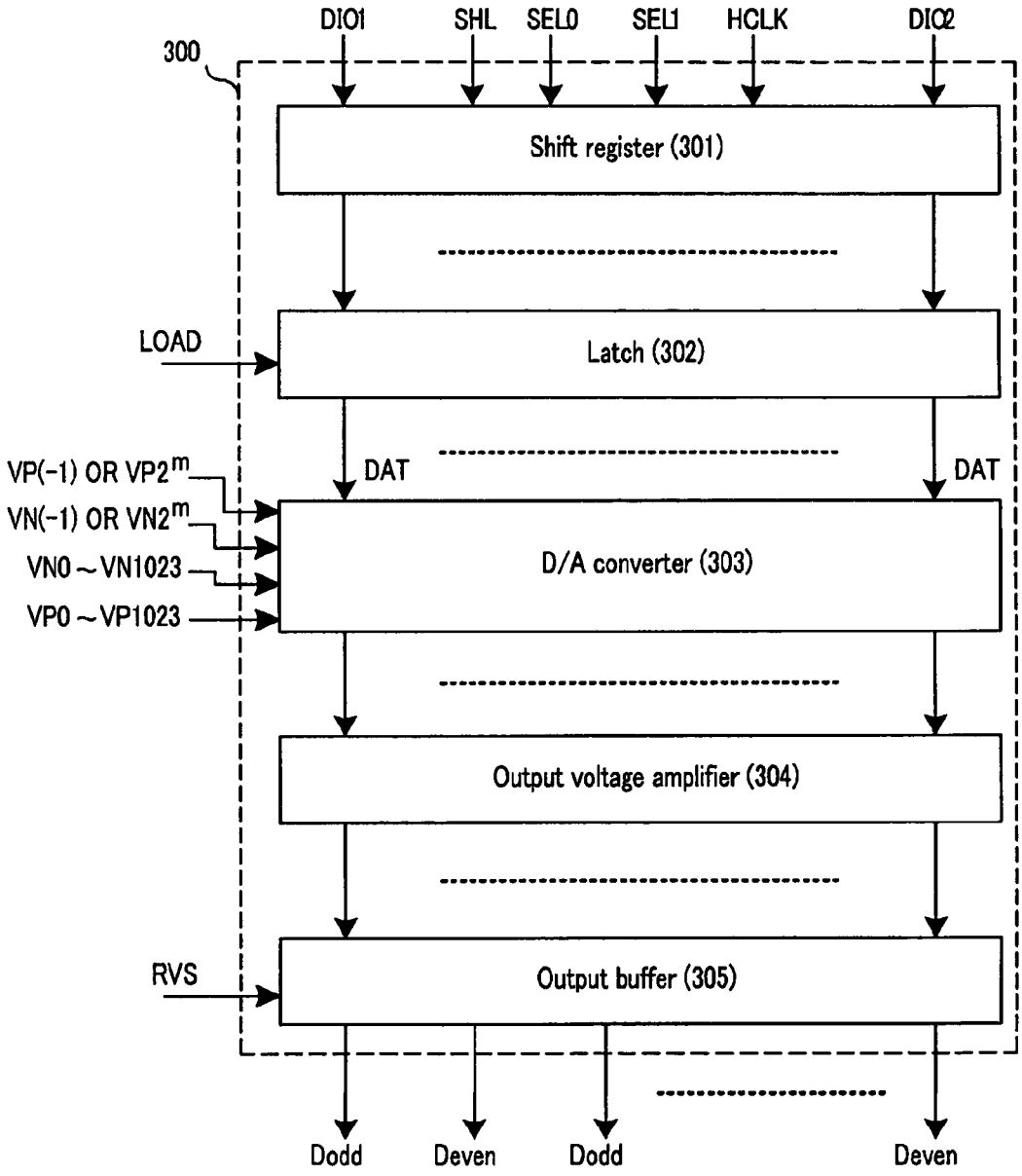
FIG. 5 shows a block diagram of a data driver 300 according to an exemplary embodiment of the present invention.

FIG. 5 shows a block diagram of a data driver 300 according to an exemplary embodiment of the present invention.

As shown in FIG. 5, the data driver 300 includes a shift register 301, a latch 302, a digital to analog (D/A) converter 303, an output voltage amplifier 304, and an output buffer 305.

The shift register 301 receives a data clock signal HCLK and a plurality of control signals SHL, SEL0, and SEL1 from the signal controller 500, determines the functions of pulse input/output terminals 0101 and 0102 according to the level of the shift direction control signal SHL, and determines the shift direction. For example, when the shift direction control signal SHL is High, the pulse input/output terminal D101 functions as an input pin of a start pulse (not shown) for ordering the operation start of the shift register 301, and the pulse input/output terminal D102 functions as an output pin of the start pulse. When the shift direction control signal SHL is Low, the functions of the pulse input/output terminals D101 and 0102 are changed. The control signals SEL0 and SEL1 are output selection signals, and the enabled output terminal is determined from among the output terminals of the shift register 301 according to respective levels of the control signal SEL0 and SEL1.

The latch 302 stores the digital video signal DAT input by the signal controller 500 according to the enable signal input by the shift register 301. The shift register 301 shifts the position of the output terminal for outputting the enable signal in synchronization with the data clock signal HCK so that the area of the latch 302 corresponding to the output terminals of the shift register 301 is also sequentially shifted. Accordingly, the digital video signal DAT input by the signal controller 500 is sequentially stored in the entire area of the latch 302.

When the digital video signal DAT input by the signal controller 500 is stored in the entire area of the latch 302, the data driving integrated circuit outputs a carry signal to the neighboring data driving integrated circuit so that the data driving integrated circuit may also perform the same operation. The digital video signal DAT corresponding to one row is divided and stored in the latch 302 of the data driver 300.

When the digital video signal DAT corresponding to one row is stored in the entire area of the latch 302, the signal controller 500 changes the level of the load signal LOAD applied to the latch 302 so that the digital video signal DAT stored in the entire area of the latch 302 is transmitted to the digital to analog (D/A) converter 303.

The digital to analog (D/A) converter 303 includes a plurality of positive decoders corresponding to the odd-numbered area of the latch 302 and a plurality of negative decoders corresponding to the even-numbered area of the latch 302. The positive decoders receive reference gray voltages VP0 to VP1023 of positive values Vcom to VDD and a voltage VP(−1) or VP$2^m$ from the reference grayscale voltage generator 400, select a gray voltage (data signal) corresponding to the digital video signal DAT input from the odd-numbered area of the latch 302, and output the gray voltage to the output voltage amplifier 304. The negative decoders receive reference gray voltages VN0 to VN1023 of negative values VSS to Vcom and a voltage VN(−1) or VN$2^m$ from the reference grayscale voltage generator 400, select a gray voltage (data signal) corresponding to the digital video signal DAT input from the even-numbered area of the corresponding latch 302, and output the gray voltage to the output voltage amplifier 304. Here, VP(−1) is less than the common voltage Vcom by a predetermined level or is greater than the common voltage Vcom by a predetermined level, and VN(−1) is less than the common voltage Vcom by a predetermined level or greater than the common voltage Vcom by a predetermined level. Also, VN$2^m$ is greater than VSS by a predetermined level, and VP$2^m$ is less than VDD by a predetermined level. Further, m represents the bit number of the digital video signal DAT input to the digital to analog (D/A) converter 303 from the latch 302.

Differing from the above description, the positive decoder of the digital to analog (D/A) converter 303 can be also formed to correspond to the even-numbered area of the latch 302, and the negative decoder can be formed to correspond to the odd-numbered area of the latch 302.

The output voltage amplifier 304 includes a plurality of output amplifiers (not shown). Each output amplifier functions as a voltage follower.

The output buffer 305 includes a plurality of mux (MUX) circuits (not shown). Respective input terminals of the mux circuits are coupled to a pair of voltage followers for receiving output signals of the positive decoder and the negative decoder, and output terminals thereof are coupled to two consecutive data lines (Dodd, Deven) from among the data lines D1-Dm. Each mux circuit selectively outputs two data signals that are provided by a pair of voltage followers through one of the two data lines (Dodd, Deven) according to the inversion signal RVS input by the signal controller 500.

Figure 6:
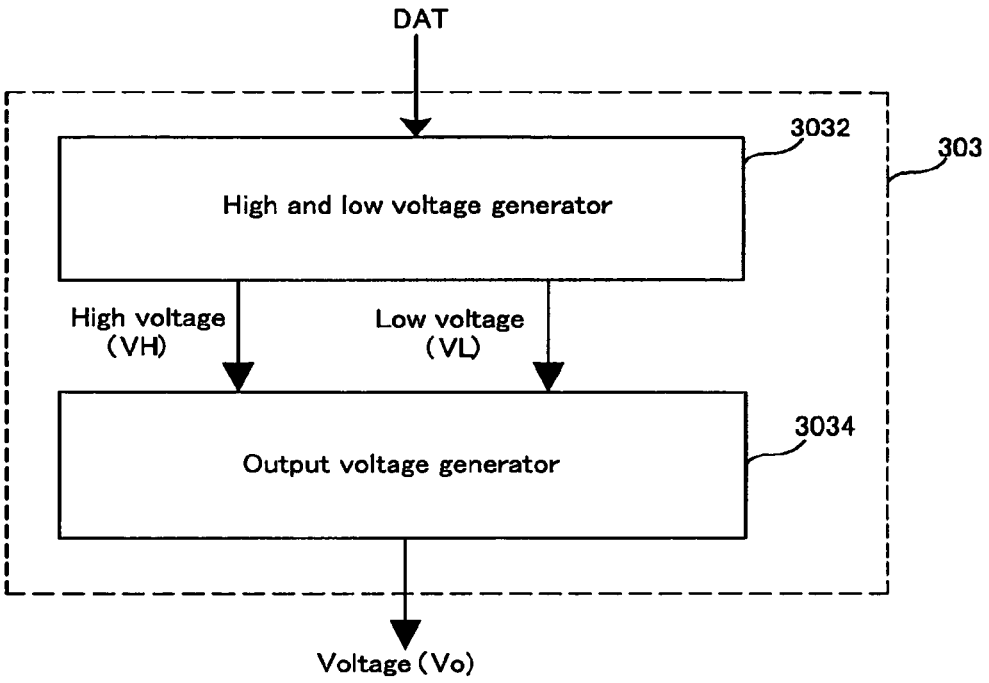
FIG. 6 shows a block diagram of a digital to analog (D/A) converter 303 according to a first exemplary embodiment of the present invention.

FIG. 6 shows a block diagram of a digital to analog (D/A) converter 303 according to a first exemplary embodiment of the present invention.

As shown in FIG. 6, the digital to analog (D/A) converter 303 includes a high and low voltage generator 3032 and an output voltage generator 3034.

The high and low voltage generator 3032 generates a high voltage and a low voltage (VH, VL) by using as many bits as a predetermined bit number, excluding the low-order bits, from among the digital video signal DAT input by the latch 302. Here, the high voltage (VH) represents a voltage having a great voltage difference with the common voltage Vcom from among the two voltages output by the high and low voltage generator 3032, and the low voltage (VL) represents a voltage having a less voltage difference with the common voltage Vcom from among the two voltages output by the high and low voltage generator 3032.

The output voltage generator 3034 receives the high voltage (VH) and the low voltage (VL) from the high and low voltage generator 3032, and generates a plurality of voltages Vo by using the low-order bits that are not used for generating the high voltage and the low voltage (VH, VL) by the high and low voltage generator 3032.

For example, when the digital video signal DAT input by the latch 302 has 10 bits and predetermined low-order bits are 2 bits, the high and low voltage generator 3032 generates a high voltage VH and a low voltage VL by using the higher 8 bits from among the 10 bits. The output voltage generator 3034 uses the lower 2 bits that are not used by the high and low voltage generator 3032 to convert the high voltage VH and the low voltage VL input by the high and low voltage generator 3032 and generate four voltages Vo.

The number of bits of the digital video signal DAT input by the latch 302 will be given as m. Also, the bit number of low-order bits that are not used for generating the high voltage and the low voltage (VH, VL) by the high and low voltage generator 3032 but that are used for generating the voltage V0 by the output voltage generator 3034 from among the digital video signal DAT input by the latch 302 is given as k. Here, k is an integer less than m. The m−k bits generated by subtracting k low-order bits used for generating the voltage V0 by the output voltage generator 3034 from the m-bit digital video signal DAT input by the latch 302 will be called high-order bits, and m and k will be assumed to be 10 and 2, respectively. Further, the m-th bit from among the m bits represents the highermost bit from among the bits included in the m bits, and the first bit indicates the lowermost bit from among the bits included in the m bits. A gray level represents a gray voltage corresponding to a value that is generated by converting the 10-bit digital video signal DAT into a 10-ary number.

Figure 7:
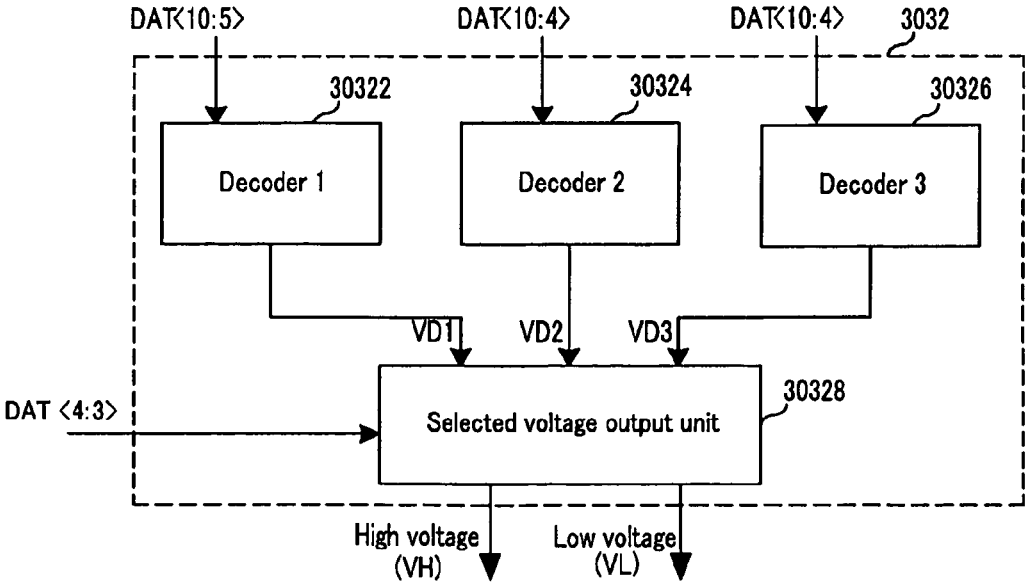
FIG. 7 shows a block diagram of a high and low voltage generator 3032 according to an exemplary embodiment of the present invention.

FIG. 7 shows a block diagram of a high and low voltage generator 3032 according to an exemplary embodiment of the present invention.

As shown in FIG. 7, the high and low voltage generator 3032 includes first to third decoders 30322, 30324, and 30326, and a selected voltage output unit 30328. For reference, the first to third decoders 30322, 30324, and 30326 shown in FIG. 7 exemplify positive decoders, and the realization of negative decoders will be described later.

The first decoder 30322 receives 6 bits excluding 4 low bits from among the 10-bit digital video signal DAT output by the latch 302, generates a voltage VD1 according to the bit values of the respective input bits, and outputs it to the selected voltage output unit 30328.

The second decoder 30324 receives 7 bits excluding 3 low bits from among the 10-bit digital video signal DAT output by the latch 302, generates a voltage VD2 according to the bit values of the respective input bits, and outputs it to the selected voltage output unit 30328.

The third decoder 30326 receives 7 bits excluding 3 low bits from among the 10-bit digital video signal DAT output by the latch 302, generates a voltage VD3 according to the bit values of the respective input bits, and outputs it to the selected voltage output unit 30328.

The selected voltage output unit 30328 selects two voltages (VH, VL) from among the voltages that are input by the first to third decoders 30322, 30324, and 30326 according to the bit values of the 8 high-order bits and the 2 low-order bits from among the 10-bit digital video signal DAT output by the latch 302, and transmits the voltages to the output voltage generator 3034.

The first to third decoders 30322, 30324, and 30326 according to a first exemplary embodiment of the present invention will now be described with reference to FIG. 8 to FIG. 10.

Figure 8:
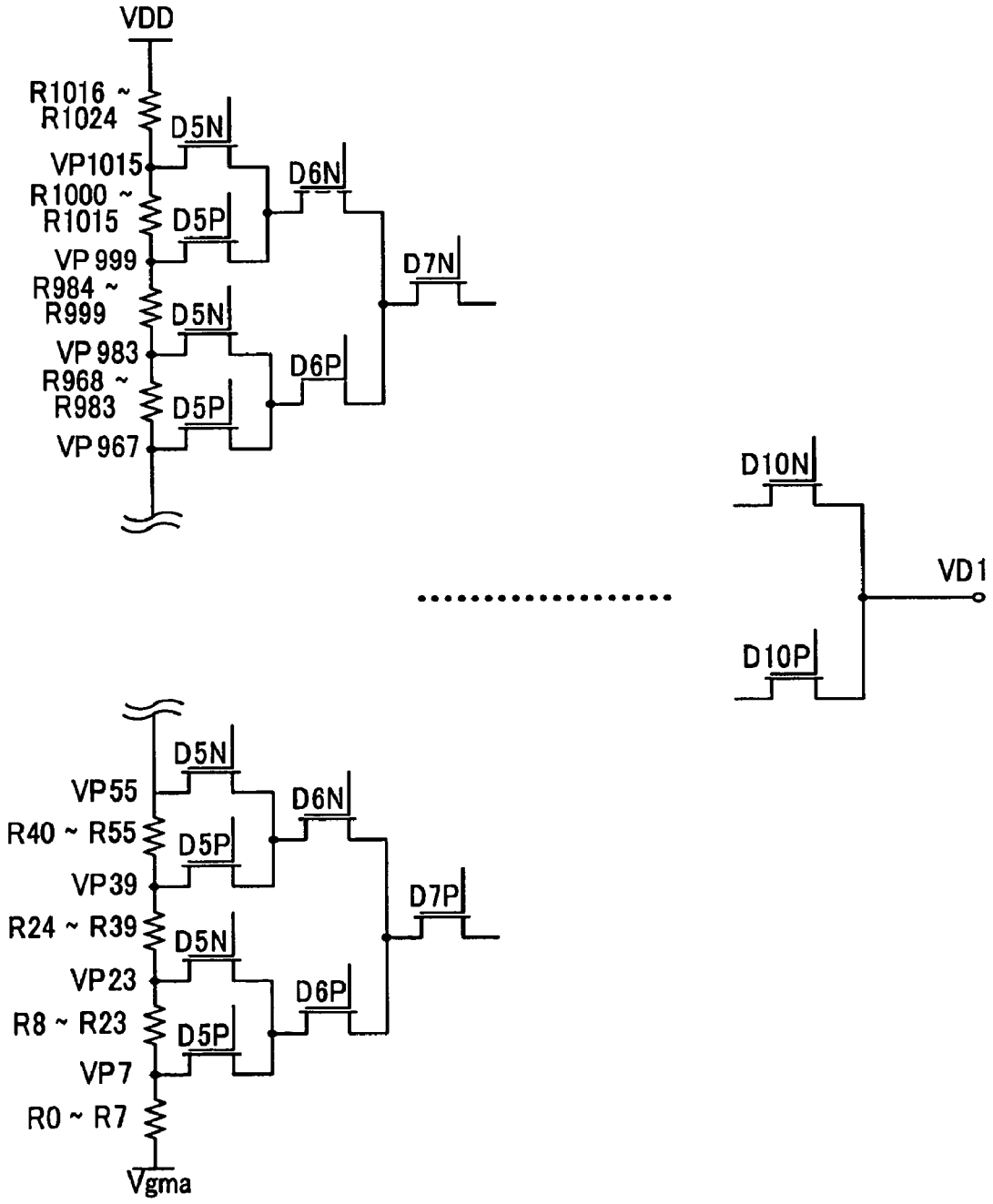
FIG. 8 shows a first decoder 30322 according to a first exemplary embodiment of the present invention.
Figure 9:
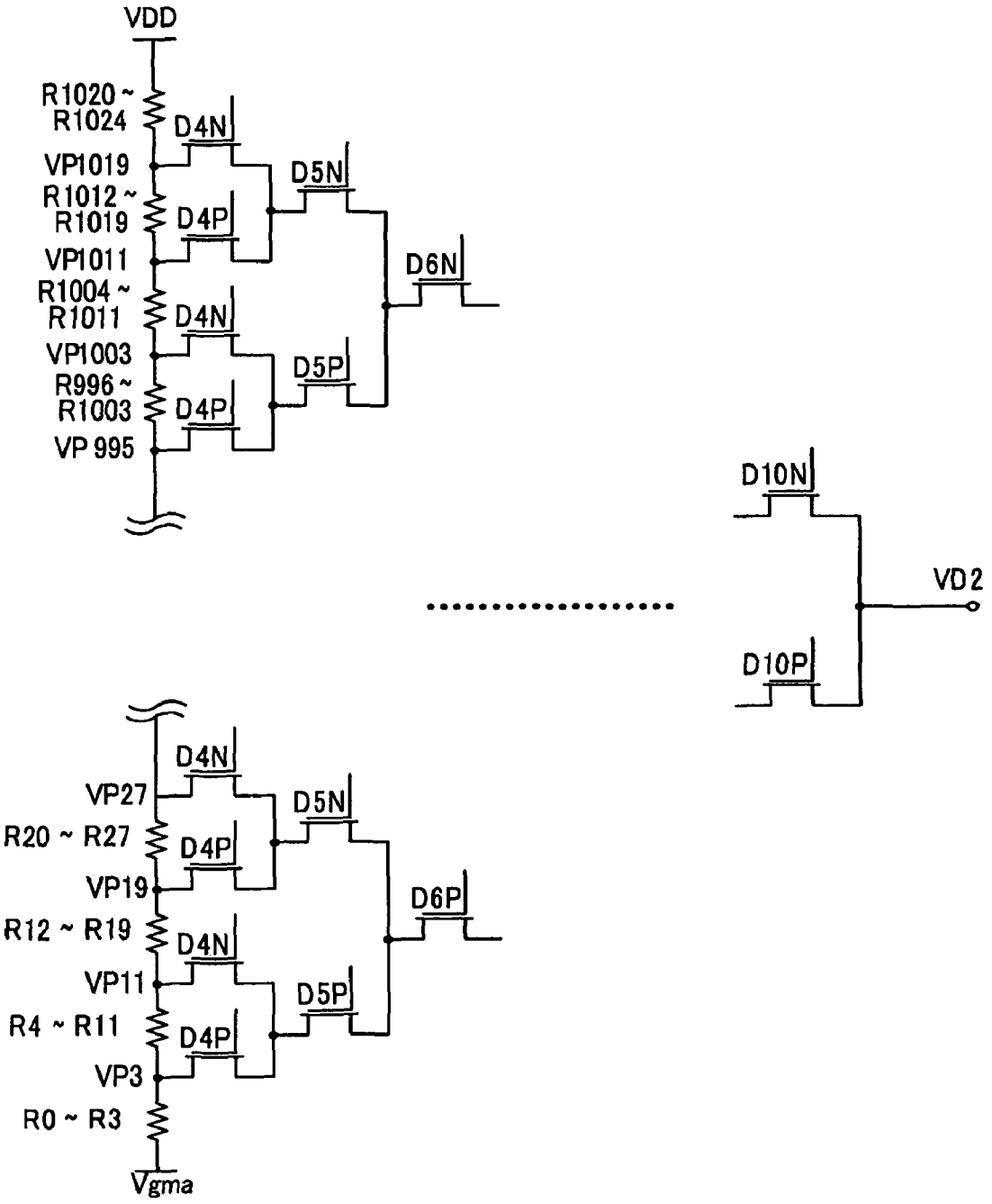
FIG. 9 shows a second decoder 30324 according to a first exemplary embodiment of the present invention.
Figure 10:
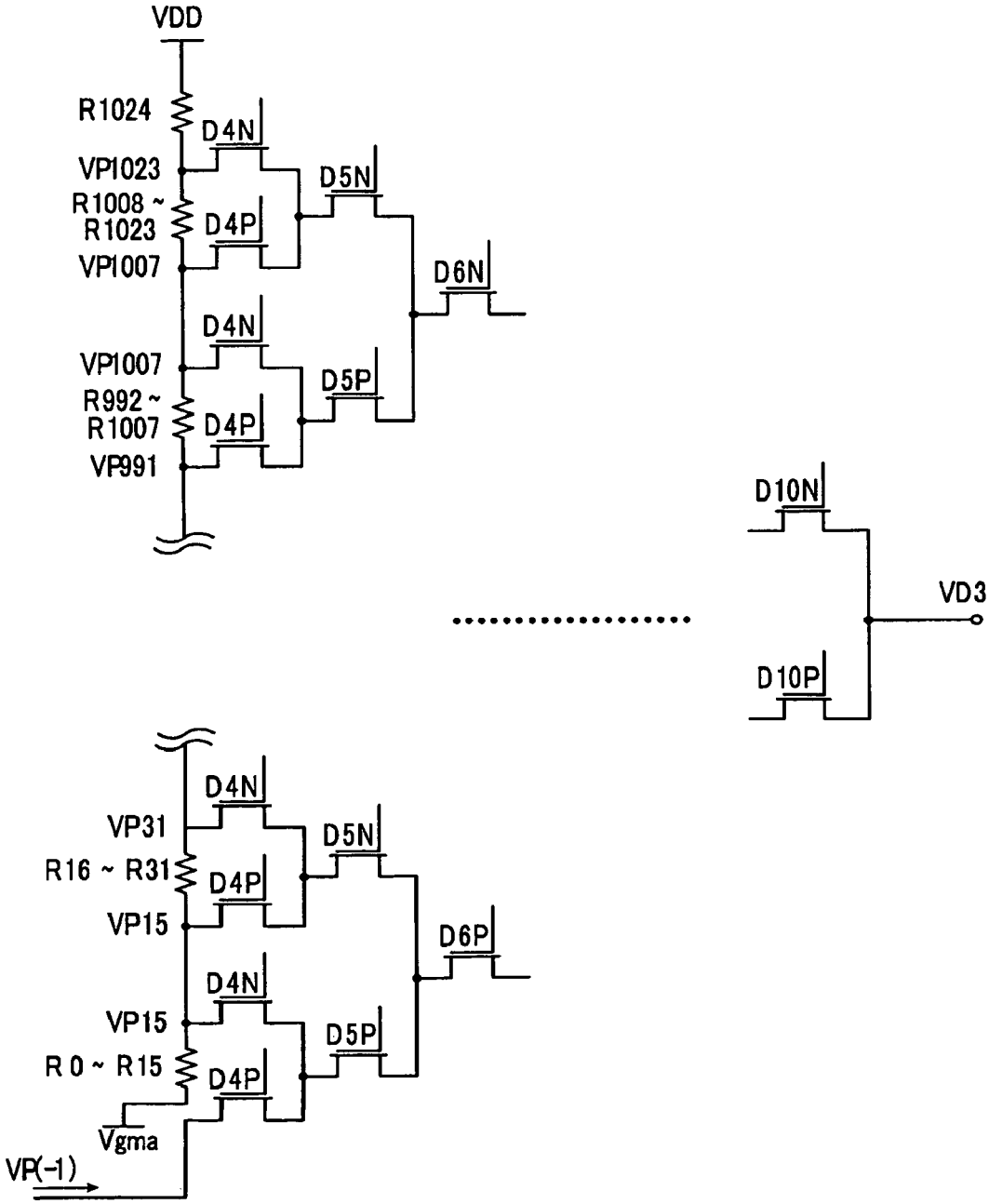
FIG. 10 shows a third decoder 30326 according to a first exemplary embodiment of the present invention.

In FIG. 8 to FIG. 10, VP3, VP7, VP11, . . . , VP1015, VP1019, and VP1023 respectively show one of $2^{10}$ gray voltages VP0 to VP1023 that are generated by partially pressuring the voltage VDD with $2^{10}+1$ resistors R1 to R1024 from the voltage Vgma from among the reference gray voltages Vcom to VDD that are input by the reference grayscale voltage generator 400. Here, the voltage Vgma is greater than the common voltage Vcom by a predetermined level. In FIG. 8 to FIG. 10, switches D4N, D4P, D5N, D5P, D6N, D6P, . . . , D10N, and D10P included in the first to third decoders 30322, 30324, and 30326 are formed with the same type of switches, that is, P-type field effect transistors. Alternatively, the switches D4N, D4P, D5N, D5P, D6N, D6P, . . . , D10N, and D10P can be formed with N-type field effect transistors, and the signals that are input to control electrodes of the switches D4N, D4P, D5N, D5P, D6N, D6P, . . . , D10N, and D10P are inverted. The switches included in the decoders 30322, 30324, and 30326 are formed as the same type in order to reduce the layout area of the high and low voltage generator 3032 according to the exemplary embodiment of the present invention, which is well known to a person of ordinary skill in the art and will not be described. Also, in FIG. 8 to FIG. 10, D10N and D10P show switches that are driven to be turned on/off by the bit value of the tenth bit that is the highermost bit from among the 10-bit digital video signal DAT and the inversion signal of the bit value of the tenth bit. In a like manner, D6N, D5N, and D4N are switches that are driven to be turned on/off by the bit values of the sixth bit, the fifth bit, and the fourth bit from among the 10-bit digital video signal DAT, and D6P, D5P, and D4P are switches that are driven to be turned on/off by the bit values of the sixth bit, the fifth bit, and the fourth bit from among the 10-bit digital video signal DAT.

FIG. 8 shows a first decoder 30322 according to a first exemplary embodiment of the present invention, and FIG. 9 shows a second decoder 30324 according to the first exemplary embodiment of the present invention.

As shown in FIG. 8, the first decoder 30322 receives 6 bits from the fifth bit to the tenth bit, selects one gray voltage from among VP7 to VP1015 according to the bit values of the respective input bits, and outputs it to the voltage VD1. The first decoder 30322 receives gray voltages having a gray level difference of 16 starting from VP7, that is, 64 ($=2^6$) gray voltages VP7, VP23, VP39, VP55, . . . , VP967, VP983, VP999, and VP1015. Because of this, the number of switches included in the first decoder 30322 is $2^7-2$ ($=2^6+2^5+2^4+2^3+2^2+2^1$).

As shown in FIG. 9, the second decoder 30324 according to the first exemplary embodiment of the present invention receives 7 bits from the fourth bit to the tenth bit, selects one gray voltage from among VP3 to VP1019 according to the bit values of the input bits, and outputs it to the voltage VD2. Here, the second decoder 30324 receives the gray voltages having a gray level difference of 8 starting from VP3, that is, 128 ($=2^7$) gray voltages of VP3, VP11, VP19, VP27, . . . , VP995, VP1003, VP1011, and VP1019. Because of this, the number of switches included in the second decoder 30324 is $2^8-2$ ($=2^7+2^6+2^5+2^4+2^3+2^2+2^1$).

FIG. 10 shows a third decoder 30326 according to the first exemplary embodiment of the present invention. In FIG. 10, VP(−1) is generated by the reference grayscale voltage generator 400, is a little more or less than Vcom, and is defined in Equation 1.

$$VP0=VP(-1)+(VP3-VP(-1))*1/4 \quad \text{(Equation 1)}$$

That is, VP(−1) is less than VP0 by VP1−VP0.

As shown in FIG. 10, the third decoder 30326 receives 7 bits from the fourth bit to the tenth bit, selects one gray voltage from among VP(−1) to VP1023 according to the bit values of the respective input bits, and outputs it to the voltage VD3. Here, the third decoder 30326 receives the gray voltages having a gray level difference of 16 starting from VP15, that is, 128 ($2^7$) gray voltages of VP15, VP31, VP47, . . . , VP991, VP1007, and VP1023, and VP(−1), and is configured to receive voltages other than the lowest voltage VP(−1) and the highest voltage VP1023 from among the input gray voltages through two switches. Because of this, the number of switches included in the third decoder 30326 is $2^8-2$ ($=2^7+2^6+2^5+2^4+2^3+2^2+2^1$).

Here, the relation among the lowest voltages that are input to the first to third decoders 30322, 30324, and 30326 according to the first exemplary embodiment of the present invention is as follows. That is, the lowest voltage VP7 input to the first decoder 30322 is set to be greater than the lowest voltage VP3 input to the second decoder 30324 by the gray level 4, and the lowest voltage VP(−1) input to the third decoder 30326 is set to be less than the voltage VP3 input to the second decoder 30324 by the gray level 4. Also, the voltages VD1' to VD3' that are output by the first to third decoders 30322, 30324, and 30326 according to the first exemplary embodiment of the present invention have a voltage difference by the gray level 4 in correspondence to the bit values of the 7 bits from the fourth bit to the tenth bit of the digital video signal DAT.

A voltage output unit 30328 according to an exemplary embodiment of the present invention will now be described with reference to FIG. 11.

Figure 11:
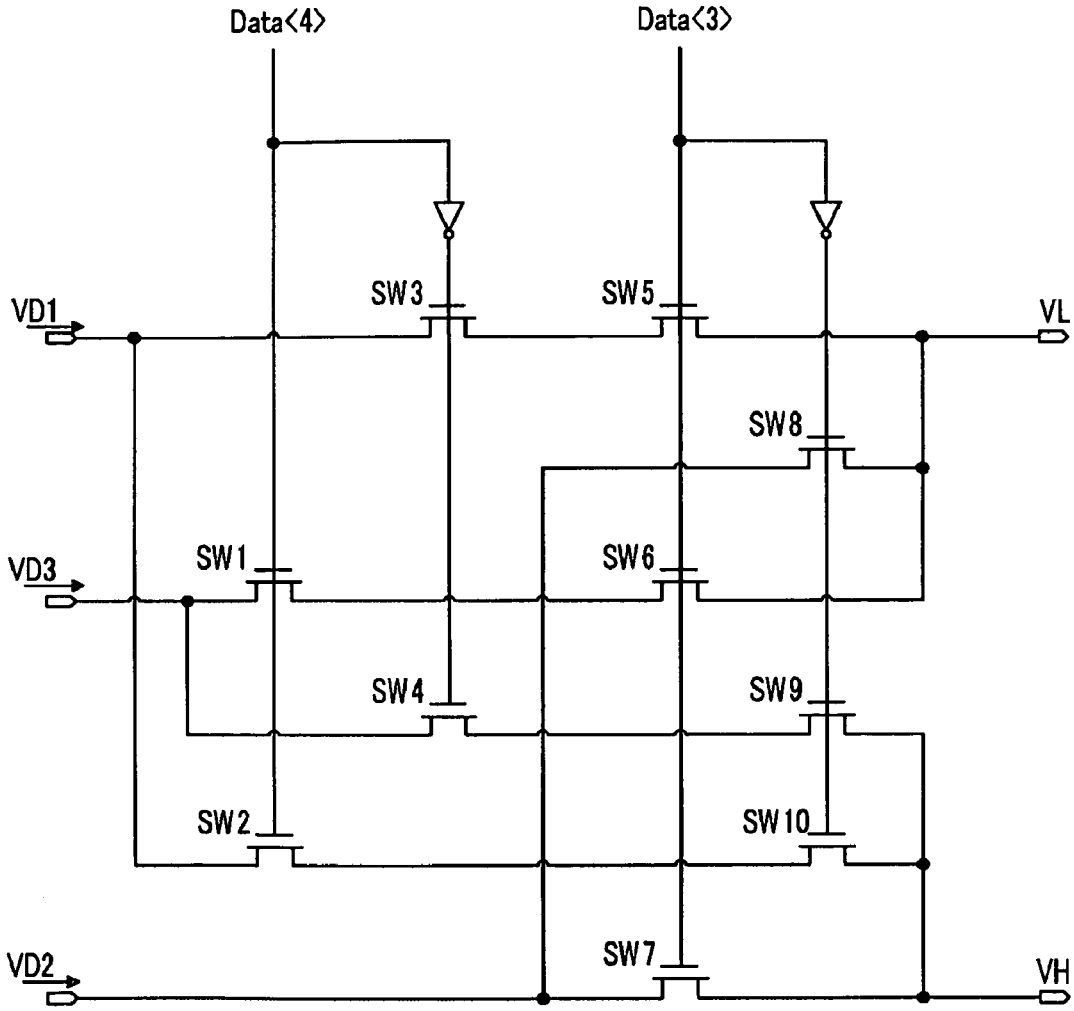
FIG. 11 shows a brief drawing of a selected voltage output unit 30328 according to an exemplary embodiment of the present invention.

FIG. 11 shows a brief drawing of a selected voltage output unit 30328 according to an exemplary embodiment of the present invention. For reference, in FIG. 11, the switches SW1 to SW10 included in the selected voltage output unit 30328 are formed with the same type of switches, that is, N-type field effect transistors. The switches D4N, D4P, D5N, D5P, D6N, D6P, . . . , D10N, D10P can be formed with P-type field effect transistors, and in this instance, the signals that are input to the control electrodes of the switches SW1 to SW10 are inversion signals. Here, the switches SW1 to SW10 included in the selected voltage output unit 30328 are formed as the same type in order to reduce the layout area of the switches SW1 to SW10 included in the selected voltage output unit 30328 according to the exemplary embodiment of the present invention.

As shown in FIG. 11, the selected voltage output unit 30328 includes a plurality of switches SW1 to SW10. The switches SW1 to SW10 are turned on/off by the bit values of the third bit and the fourth bit from among the 10-bit digital video signal DAT, select two voltages from among the voltages VD1 to VD3 input by the first to third decoders 30322, 30324, and 30326, and output the two voltages. The high voltage (VH) and the low voltage (VL) output by the selected voltage output unit 30328 according to the bit values of the third bit and the fourth bit are shown in Table 1. For reference, in Table 1, Data<4> and Data<3> represent the bit values of the fourth bit and the third bit from among the 10-bit digital video signal DAT output by the latch 302.

TABLE 1

| Data <4> | Data <3> | VH | VL |
|---|---|---|---|
| 0 | 0 | VD3 | VD2 |
| 0 | 1 | VD2 | VD1 |
| 1 | 0 | VD1 | VD2 |
| 1 | 1 | VD2 | VD3 |

Since the voltages VD1 to VD3 output by the first to third decoders 30322, 30324, and 30326 according to the first exemplary embodiment of the present invention always mutually have a gray level difference of 4, the two voltages (VH, VL) output by the selected voltage output unit 30328 according to the exemplary embodiment of the present invention mutually have the voltage difference by the gray level 4.

An output voltage generator 3034 according to a first exemplary embodiment of the present invention will now be described with reference to FIG. 12.

Figure 12:
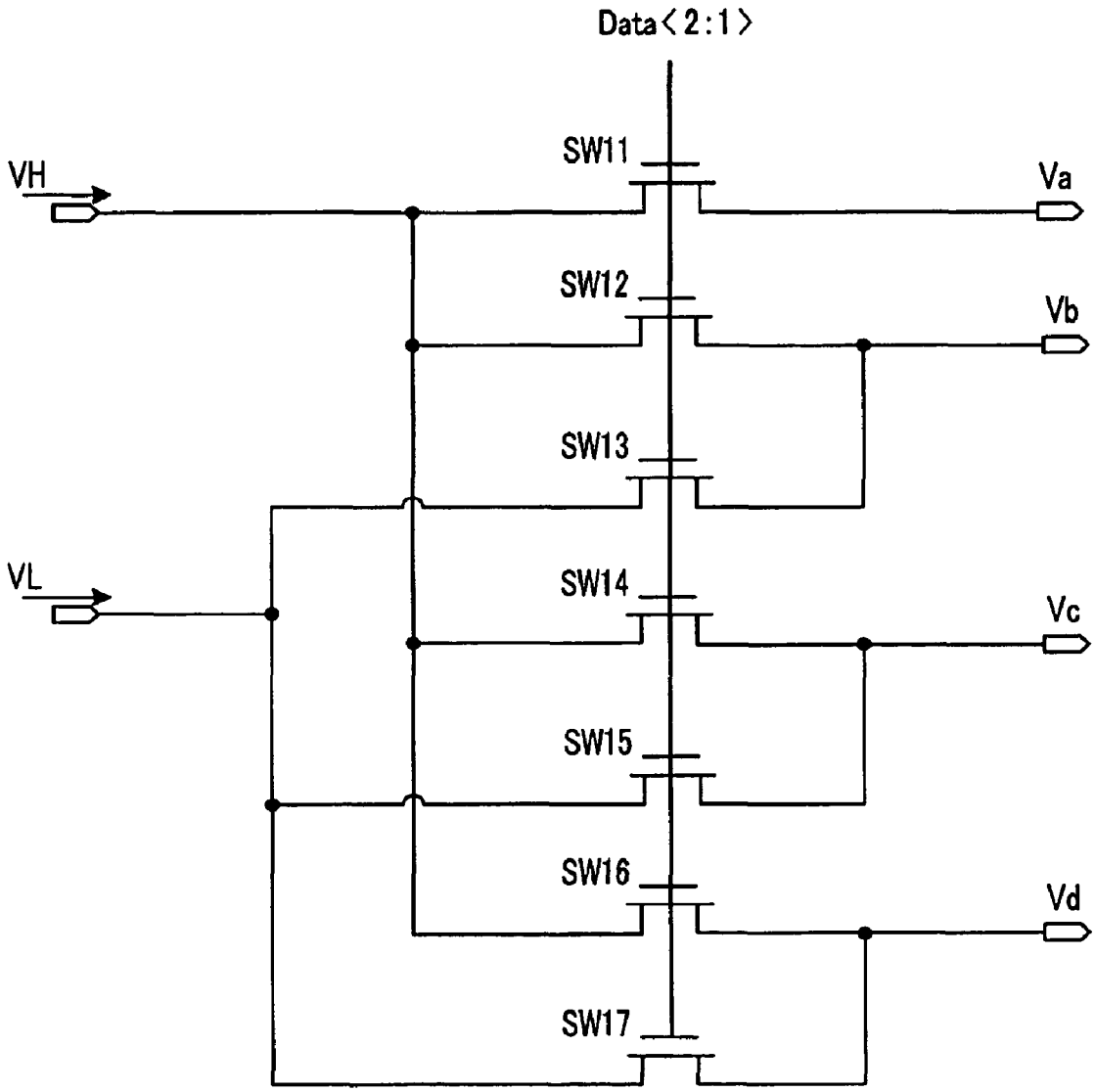
FIG. 12 shows an output voltage generator 3034 according to a first exemplary embodiment of the present invention.

FIG. 12 shows an output voltage generator 3034 according to a first exemplary embodiment of the present invention.

As shown in FIG. 12, the output voltage generator 3034 includes a plurality of switches SW11 to SW17, generates four voltages Va, Vb, Vc, and Vd by using the high voltage (VH) and the low voltage (VL) input by the selected voltage output unit 30328, and outputs them to the output voltage amplifier 304.

A plurality of switches SW12 to SW17 are turned on/off according to the bit values of the first bit and the second bit, that is, the two bits except the bits from the third bit to the tenth bit used by the high and low voltage generator 3032 from among the 10-bit digital video signal DAT input by the latch 302. The switch SW11 is always turned on.

In detail, the switch SW11 transmits the high voltage (VH) input to one terminal to a first voltage output terminal. The switch SW12 is turned on when the bit values of the first bit and the second bit are 01, 10, and 11, and it transmits the input high voltage (VH) to a second voltage output terminal. The switch SW13 is turned on when the bit values of the first bit and the second bit are 00, and it transmits the low voltage (VL) input to one terminal to the second voltage output terminal. The switch SW14 is turned on when the bit values of the first bit and the second bit are 10 and 11, and it transmits the high voltage (VH) input to one terminal to a third voltage output terminal. The switch SW15 is turned on when the bit values of the first and second bits are 00 and 01, and it transmits the low voltage (VL) input to one terminal to the third voltage output terminal. The switch SW16 is turned on when the bit values of the first and second bits are 11, and it transmits the high voltage (VH) input to one terminal to the fourth voltage output terminal. The switch SW17 is turned on when the bit values of the first and second bits are 00, 01, and 10, and it transmits the low voltage (VL) input to one terminal to a fourth voltage output terminal.

In FIG. 12, the four voltages Va, Vb, Vc, and Vd generated by the output voltage generator 3034 according to the first exemplary embodiment of the present invention are determined to be one of ① to ④.

① When the bit values of the first and second bits are 0, Va=high voltage (VH), and Vb=Vc=Vd=low voltage (VL).
② When the first bit is 1 and the second bit is 0, Va=Vb=high voltage (VH), and Vc=Vd=low voltage (VL).
③ When the first bit is 0 and the second bit is 1, Va=Vb=Vc=high voltage (VH), and Vd=low voltage (VL).
④ When the bit values of the first and second bits are 1, Va=Vb=Vc=Vd=high voltage (VH).

Figure 13:
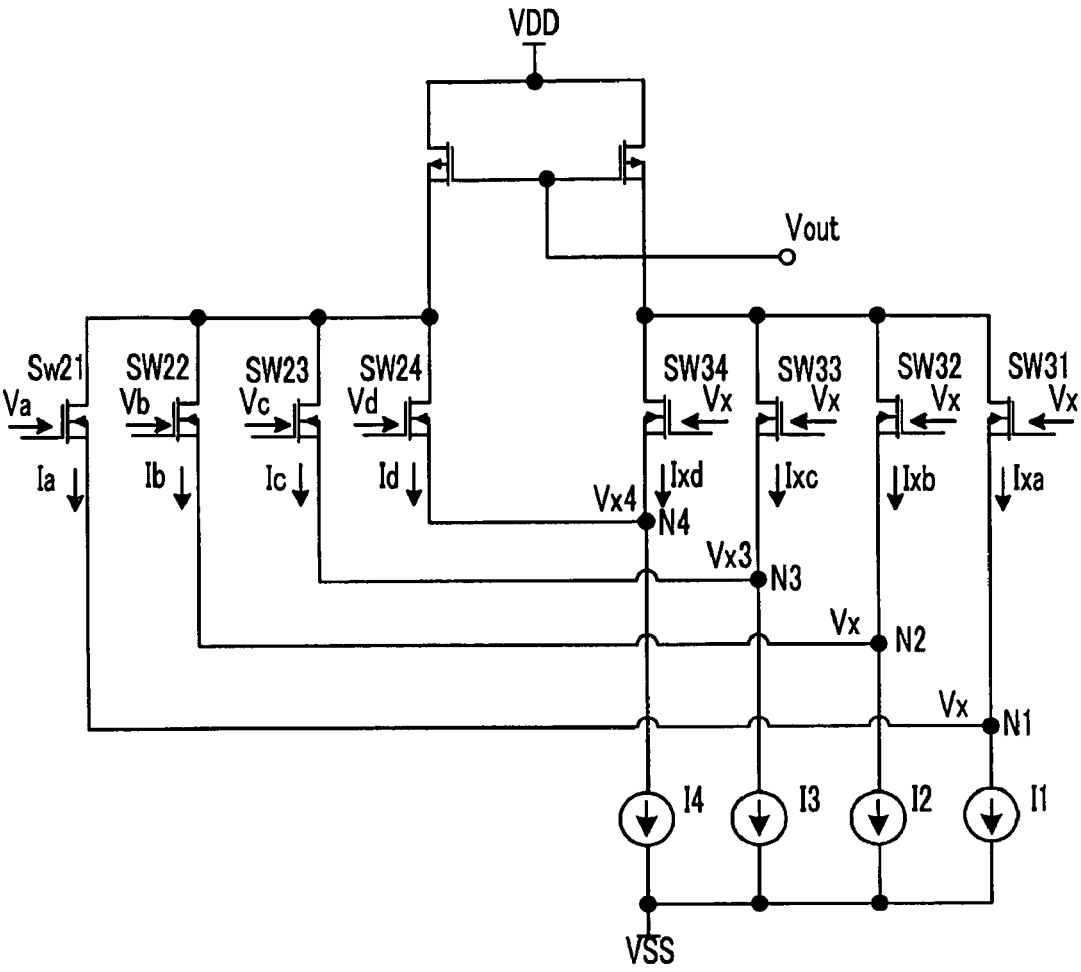
FIG. 13 shows a brief drawing of an output voltage amplifier 304 according to an exemplary embodiment of the present invention.

FIG. 13 shows a brief drawing of an output voltage amplifier 304 according to an exemplary embodiment of the present invention. For reference, in FIG. 13, transistors SW21, SW22, SW23, SW24, SW31, SW32, SW33, and SW34 are shown as N-type field effect transistors, and differing from this, the transistors SW21, SW22, SW23, SW24, SW31, SW32, SW33, and SW34 can also be configured with P-type field effect transistors. Also, the transistors SW21, SW22, SW23, SW24, SW31, SW32, SW33, and SW34 can be realized by other switches performing the same function.

As shown in FIG. 13, the output voltage amplifier 304 according to the exemplary embodiment of the present invention includes an output amplifier. One input terminal from among the two input terminals of the output amplifier includes four transistors SW21, SW22, SW23, and SW24 driven by the four voltages Va, Vb, Vc, and Vd, and another input terminal includes four transistors SW31, SW32, SW33, and SW34 driven by a feedback signal Vx. Here, the output voltage Vout is a gray voltage applied to the pixel 110 through the data lines D1-Dm, and the feedback signal Vx corresponds to the output voltage Vout being output through the output terminal.

One terminal of each of the transistor SW21 and the transistor SW31 has a node N1, and they are coupled to the power source VSS for supplying the VSS voltage through a current source I1. One terminal of each of the transistor SW22 and the transistor SW32 has a node N2, and they are coupled to the power source VSS for supplying the VSS voltage through a current source I2. One terminal of each of the transistor SW23 and the transistor SW33 has a node N3, and they are coupled to the power source VSS for supplying the VSS voltage through a current source I3. One terminal of each of the transistor SW24 and the transistor SW34 has a node N4, and are they coupled to the power source VSS for supplying the VSS voltage through a current source I4.

The currents Ia, Ib, Ic, and Id respectively flowing to the one terminal of each of the transistors SW21, SW22, SW23, and SW24 are proportional to the levels of the four voltages Va, Vb, Vc, and Vd input to gates of the transistors SW21, SW22, SW23, and SW24. The transistors SW31, SW32, SW33, and SW34 are driven by receiving the same feedback signal Vx through gates, and the voltages Vx1, Vx2, Vx3, and Vx4 respectively applied to one terminal of each of the transistors SW31, SW32, SW33, and SW34 are variable by the currents Ia, Ib, Ic, and Id, and the output voltage (Vout) is accordingly varied. That is, as the voltages Vx1, Vx2, Vx3, and Vx4 respectively applied to the one terminal of each of the transistors SW31, SW32, SW33, and SW34 are varied, the currents Ixa, Ixb, Ixc, and Ixd respectively flowing to the one terminal of each of the transistors SW31, SW32, SW33, and SW34 driven by the gate control voltage Vx are varied. Since the output terminal of the output amplifier commonly has a node with other terminals of the transistors SW31, SW32, SW33, and SW34, the output voltage Vout is varied according to the change of the voltage difference between the power source VSS for supplying the voltage VSS and the voltage at the output terminal of the output amplifier as the currents Ixa, Ixb, Ixc, and Ixd respectively flowing to one terminal of each of the transistors SW31, SW32, SW33, and SW34 are varied.

That is, the level of the output voltage Vout is varied depending on what case of ① to ④ the four voltages Va, Vb, Vc, and Vd generated by the output voltage generator 3034 according to the first exemplary embodiment of the present invention belong. In detail, assuming that the voltage difference between the high voltage VH and the low voltage VL output by the selected voltage output unit 30328 is Δ, the output voltage Vout for the four cases ① to ④ is the combined value of the high voltage VH and the low voltage VL as shown in a) to d).

a) If Va=high voltage VH, and Vb=Vc=Vd=low voltage VL,
then, output voltage Vout=low voltage VL+(Δ/4)*high voltage VH.

b) If Va=Vb=high voltage VH, and Vc=Vd=low voltage VL,
then, output voltage Vout=low voltage VL+(2Δ/4)*high voltage VH.

c) If Va=Vb=Vc=high voltage VH, and Vd=low voltage VL,
then, output voltage Vout=low voltage VL+(3Δ/4)*high voltage VH.

d) If Va=Vb=Vc=Vd=high voltage VH,
then, output voltage Vout=high voltage VH.

Since the two voltages (VH, VL) output by the selected voltage output unit 30328 have the voltage difference by the gray level 4, the output voltage amplifier 304 can output all gray levels corresponding to the digital video signal DAT.

This is because the output voltage Vout is the combined value of the high voltage VH and the low voltage VL as shown in a) to d) in correspondence to the four cases ① to ④.

First, a gate input voltage and the corresponding current flowing to one terminal of the transistor are expressed in Equation 2.

$$I=\mu Cox(W/L)[(Vgs-Vt)Vds-\tfrac{1}{2}Vds^2] \quad \text{(Equation 2)}$$

(Here, W is the width of a transistor channel, L is the length of the transistor channel, Vgs is a voltage difference between the gate and the source of the transistor, Vt is a threshold voltage of the transistor, Vds is a voltage difference between the drain and the source of the transistor, Cox is oxide capacitance, and μ is charge mobility.)

When the current I flowing to one terminal of the transistor expressed as Equation 2 is expressed as a variation of the current I corresponding to the voltage difference between the drain and the source of the transistor, it is expressed in Equation 3.

$$\delta I=\mu Cox(W/L)[(Vgs-Vt)(\delta Vds)-\tfrac{1}{2}(\delta Vds^2)] \quad \text{(Equation 3)}$$

Here, δ is a variation, and α is a constant.

In Equation 3, when the very small value $\tfrac{1}{2}(\delta Vds^2)$ is ignored and μCox(δVds) is expressed with the constant α, the variation δI of the current I is expressed in Equation 4.

$$\delta I\approx\alpha(W/L)(Vgs-Vt) \quad \text{(Equation 4)}$$

When the currents Ia, Ib, Ic, and Id respectively flowing to one terminal of each of the transistors SW21, SW22, SW23, and SW24 are expressed by using Equation 4 in correspondence to the four voltages Va, Vb, Vc, and Vd, it is expressed in Equation 5.

$$Ia=\alpha(W21/L21)(Va-Vx1-Vt21),$$

$$Ib=\alpha(W22/L22)(Vb-Vx2-Vt22),$$

$$Ic=\alpha(W23/L23)(Vc-Vx3-Vt23),$$

$$Id=\alpha(W24/L24)(Vd-Vx4-Vt24) \quad \text{(Equation 5)}$$

Also, the currents Ixa, Ixb, Ixc, and Ixd respectively flowing to one terminal of each of the four transistors SW31, SW32, SW33, and SW34 driven by the feedback signal Vx can be used as Equation 6 by using Equation 4.

$$Ixa=\alpha(W31/L31)(Vx-Vx1-Vt31),$$

$$Ixb=\alpha(W32/L32)(Vx-Vx2-Vt32),$$

$$Ixc=\alpha(W33/L33)(Vx-Vx3-Vt33),$$

$$Ixd=\alpha(W34/L34)(Vx-Vx4-Vt34) \quad \text{(Equation 6)}$$

The two input terminals of the output voltage amplifier are formed as a current mirror, and hence, the sum of the currents respectively flowing to one terminal of each of the transistors SW21, SW22, SW23, and SW24) corresponds to the sum of the currents respectively flowing to one terminal of each of the transistors SW31, SW32, SW33, and SW34 as shown in Equation 7.

$$Ia+Ib+Ic+Id=Ixa+Ixb+Ixc+Ixd \quad \text{(Equation 7)}$$

Assuming that widths W and lengths of the channels, and threshold voltages Vt of the transistors SW21, SW22, SW23, and SW24 and the transistors SW31, SW32, SW33, and SW34 forming two input terminals of the output voltage amplifier are configured to be the same with each other, Equation 8 is expressed as follows.

$$W21=W22=W23=W24=W31=W32=W33=W34,$$

$$L21=L22=L23=L24=L31=L32=L33=L34,$$

$$Vt21=Vt22=Vt23=Vt24=Vt31=Vt32=Vt33=Vt34 \quad \text{(Equation 8)}$$

When Equation 8 is substituted for Equation 5 to 7, the relationship between the feedback signal Vx and a plurality of voltages Va, Vb, Vc, and Vd output by the decoder is expressed as Equation 9.

$$Vx=(Va+Vb+Vc+Vd)/4 \quad \text{(Equation 9)}$$

In this instance, Δ is a value generated by subtracting the low voltage VL from the high voltage VH, and hence the output voltages Vout corresponding to the four cases ① to ④ are shown as a) to d).

Figure 2:
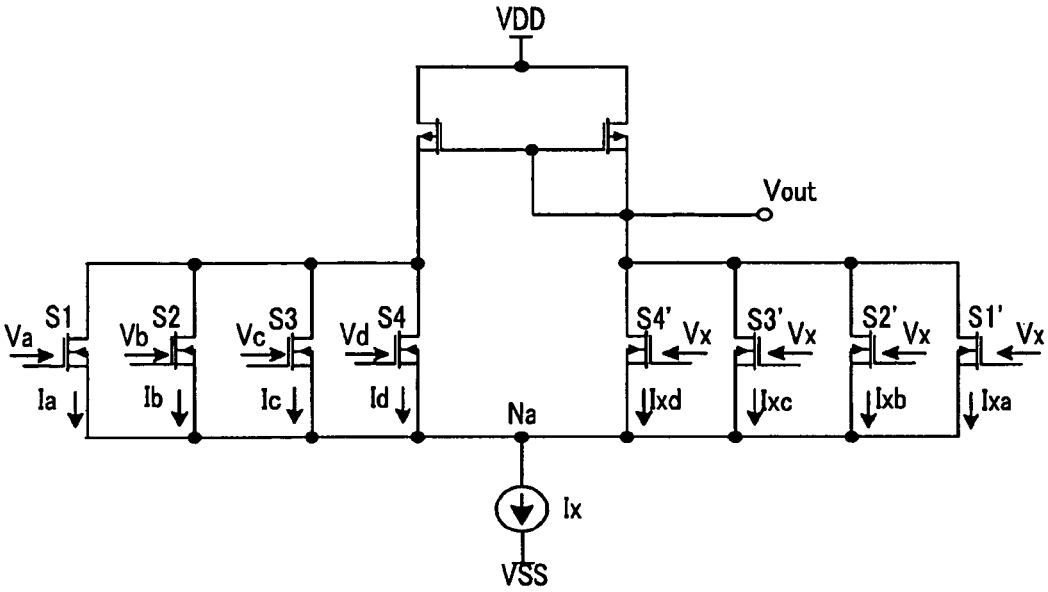
FIG. 2 shows a conventional output amplifier structure.

Regarding the cases a) to d), output voltages Vout of the output amplifier disclosed in Korean Patent No. 10-0336683 shown in FIG. 2 and the output amplifier according to the exemplary embodiment of the present invention shown in FIG. 13 will be compared with reference to FIG. 14. For reference, the output amplifier disclosed in Korean Patent No. 10-0336683 shown in FIG. 2 and the output amplifier according to the exemplary embodiment of the present invention shown in FIG. 13 are proposed so as to output the output voltages Vout of a) to d) for the four cases ① to ④.

Figure 14A:
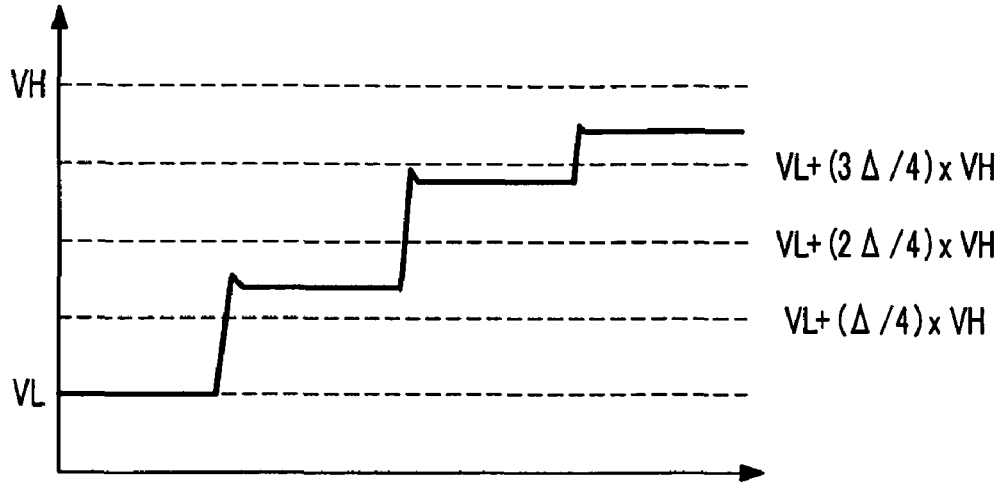
FIG. 14A shows a waveform diagram of an output voltage (Vout) of a conventional output amplifier.
Figure 14B:
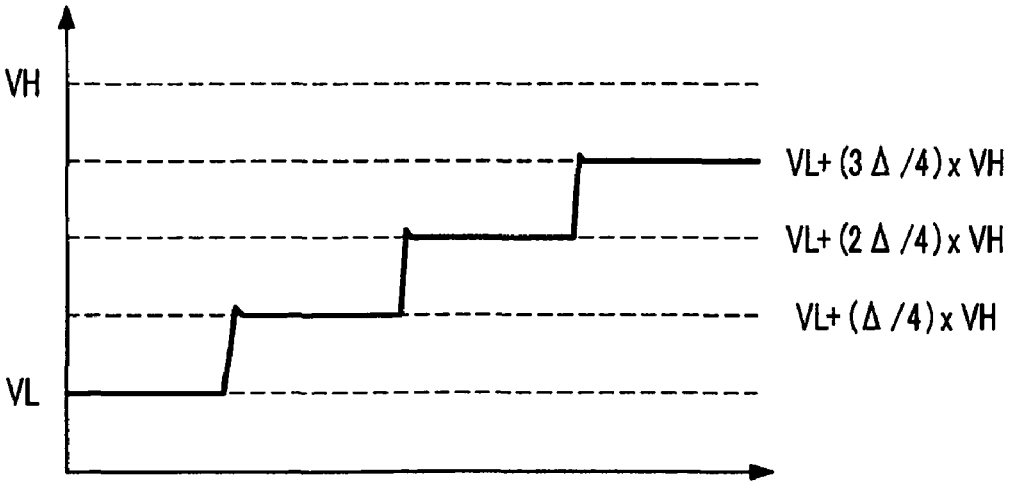
FIG. 14B shows a waveform diagram of an output voltage (Vout) of an output amplifier according to an exemplary embodiment of the present invention.

FIG. 14A shows a waveform diagram of an output voltage Vout by a conventional output amplifier, and FIG. 14B shows a waveform diagram of an output voltage Vout by an output amplifier according to an exemplary embodiment of the present invention.

As shown in FIG. 14A and FIG. 14B, the output voltage Vout of the output amplifier according to the exemplary embodiment of the present invention can generate the accurate middle voltages by combining the high voltage VH and the low voltage VL, but the output amplifier disclosed by Korean Patent No. 10-0336683 cannot generate accurate middle voltages because of the following reasons.

First, regarding the respective four cases ① to ④, the voltage applied to the node Na of the output amplifier disclosed by Korean Patent No. 10-0336683 shown in FIG. 2 is varied into different voltages Vs1, Vs2, Vs3, and Vs4. In this instance, the currents Ia, Ib, Ic, and Id respectively flowing to one terminal of each of the transistors S1, S2, S3, and S4 are given as e) to h).

e) Ia=α(W1/L1)(VH−Vs1−Vt), Ib=Ic=Id=α(W1/L1)(VL−Vs1−Vt), f) Ia=Ib=α(W1/L1)(VH−Vs2−Vt), Ic=Id=α(W1/L1)(VL−Vs2−Vt), g) Ia=Ib=Ic=α(W1/L1)(VH−Vs3−Vt), Id=α(W1/L1)(VL−Vs3−Vt), h) Ia=Ib=Ic=Id=α(W1/L1)(VH−Vs4−Vt)

As shown by e) to h), the output amplifier disclosed in Korean Patent No. 10-0336683 shown in FIG. 2 sometimes generates different currents Ia, Ib, Ic, and Id when the same voltage is input. Therefore, as shown in FIG. 14A, the output voltage Vout does not become the desired accurate middle voltage generated by combining the high voltage VH and the low voltage VL.

Differing from the output amplifier disclosed in Korean Patent No. 10-0336683, the output amplifier according to the exemplary embodiment of the present invention is configured to respectively couple the transistors SW21 and SW31, the transistors SW22 and SW32, the transistors SW23 and SW33, and the transistors SW24 and SW34 to the current sources I1, I2, I3, and I4. Accordingly, the voltage applied to the node among the transistor for receiving the high voltage VH through the gate from among the transistors SW21, SW22, SW23, and SW24, the current sources I1, I2, I3, and I4, and the transistors SW31, SW32, SW33, and SW34 is maintained at Vs1. In a like manner, the voltage applied to the node among the transistor for receiving the low voltage VH through the gate from among the transistors SW21, SW22, SW23, and SW24, the current sources I1, I2, I3, and I4, and the transistors SW31, SW32, SW33, and SW34 is maintained at Vs2. That is, regarding the four cases ① to ④, the currents Ia, Ib, Ic, and Id respectively flowing to one terminal of each of the transistors SW21, SW22, SW23, and SW24 of the output amplifier according to the exemplary embodiment of the present invention are given as i) to l). Accordingly, as shown in FIG. 14B, the output voltage Vout of the output amplifier according to the exemplary embodiment of the present invention accurately generates the desired middle voltages by combining the high voltage VH and the low voltage VL.

i) Ia=α(W1/L1)(VH−Vs1−Vt), Ib=Ic=Id=α(W1/L1)(VL−Vs2−Vt), j) Ia=Ib=α(W1/L1)(VH−Vs1−Vt), Ic=Id=α(W1/L1)(VL−Vs2−Vt), k) Ia=Ib=Ic=α(W1/L1)(VH−Vs1−Vt), Id=α(W1/L1)(VL−Vs2−Vt), l) Ia=Ib=Ic=Id=α(W1/L1)(VH−Vs1−Vt)

The output voltage Vout of the output amplifier according to the exemplary embodiment of the present invention when the digital video signal DAT is given as "0000000100". When the digital video signal DAT is "0000000100," the voltages VD1 to VD3 respectively output by the first to third decoders 30322, 30324, and 30326 become VP7, VP3, and VP(−1), and the high voltage VH and the low voltage VL output by the selected voltage output unit 30328 respectively become VP7 and VP3. In this instance, since Va from among the four voltages Va, Vb, Vc, and Vd output by the output voltage generator 3034 becomes VP7, and Vb, Vc, and Vd become VP3, it corresponds to the case a), and the output voltage Vout becomes VP3+(Δ/4)*VP7. Here, since the voltage difference Δ between the high voltage VH and the low voltage VL is VP7−VP3, (Δ/4) corresponds to VP4−VP3, and the output voltage Vout becomes VP4.

Table 2 shows the output voltages Vout of the output voltage amplifier 304 corresponding to the digital video signal DAT. For reference, in Table 2, Data<10:5>, Data<4>, Data<3>, and Data<2:1> respectively represent the bit values from the tenth bit to the fifth bit, the bit value of the fourth bit, the bit value of the third bit, and the bit values from the second bit to the first bit from among the 10-bit digital video signal DAT.

TABLE 2

| Data<10:5> | | | | | | Data<4> | VD1 | VD2 | VD3 | Data<3> | VL | VH |
|---|---|---|---|---|---|---|---|---|---|---|---|---|
| 0 | 0 | 0 | 0 | 0 | 0 | 0 | VP7 | VP3 | VP(−1) | 0 | VP(−1) | VP3 |
| | | | | | | | | | | 1 | VP3 | VP7 |
| 0 | 0 | 0 | 0 | 0 | 0 | 1 | VP7 | VP11 | VP15 | 0 | VP7 | VP11 |
| | | | | | | | | | | 1 | VP11 | VP15 |
| 0 | 0 | 0 | 0 | 0 | 1 | 0 | VP23 | VP19 | VP15 | 0 | VP15 | VP19 |
| | | | | | | | | | | 1 | VP19 | VP23 |
| 0 | 0 | 0 | 0 | 0 | 1 | 1 | VP23 | VP27 | VP31 | 0 | VP23 | VP27 |
| | | | | | | | | | | 1 | VP27 | VP31 |
| 0 | 0 | 0 | 0 | 1 | 0 | 0 | VP39 | VP35 | VP31 | 0 | VP31 | VP35 |
| | | | | | | | | | | 1 | VP35 | VP39 |
| 0 | 0 | 0 | 0 | 1 | 0 | 1 | VP39 | VP43 | VP47 | 0 | VP39 | VP43 |
| | | | | | | | | | | 1 | VP43 | VP47 |
| 0 | 0 | 0 | 0 | 1 | 1 | 0 | VP55 | VP51 | VP47 | 0 | VP47 | VP51 |
| | | | | | | | | | | 1 | VP51 | VP55 |
| 0 | 0 | 0 | 0 | 1 | 1 | 1 | VP55 | VP59 | VP63 | 0 | VP55 | VP69 |
| | | | | | | | | | | 1 | VP59 | VP63 |
| . | . | . | . | . | . | . | . | . | . | . | . | . |
| . | . | . | . | . | . | . | . | . | . | . | . | . |
| . | . | . | . | . | . | . | . | . | . | . | . | . |
| 1 | 1 | 1 | 1 | 0 | 0 | 0 | VP967 | VP963 | VP959 | 0 | VP959 | VP963 |
| | | | | | | | | | | 1 | VP963 | VP967 |
| 1 | 1 | 1 | 1 | 0 | 0 | 1 | VP967 | VP971 | VP975 | 0 | VP967 | VP971 |
| | | | | | | | | | | 1 | VP971 | VP975 |
| 1 | 1 | 1 | 1 | 0 | 1 | 0 | VP983 | VP979 | VP975 | 0 | VP975 | VP979 |
| | | | | | | | | | | 1 | VP979 | VP983 |
| 1 | 1 | 1 | 1 | 0 | 1 | 1 | VP983 | VP987 | VP991 | 0 | VP983 | VP987 |
| | | | | | | | | | | 1 | VP987 | VP991 |
| 1 | 1 | 1 | 1 | 1 | 0 | 0 | VP999 | VP995 | VP991 | 0 | VP991 | VP995 |
| | | | | | | | | | | 1 | VP995 | VP999 |
| 1 | 1 | 1 | 1 | 1 | 0 | 1 | VP999 | VP1003 | VP1007 | 0 | VP999 | VP1003 |
| | | | | | | | | | | 1 | VP1003 | VP1007 |
| 1 | 1 | 1 | 1 | 1 | 1 | 0 | VP1015 | VP1011 | VP1007 | 0 | VP1007 | VP1011 |
| | | | | | | | | | | 1 | VP1011 | VP1015 |
| 1 | 1 | 1 | 1 | 1 | 1 | 1 | VP1015 | VP1019 | VP1023 | 0 | VP1015 | VP1019 |
| | | | | | | | | | | 1 | VP1019 | VP1023 |

| Data<10:5> | | | | | | Vout | | | |
|---|---|---|---|---|---|---|---|---|---|
| | | | | | | Data<2:1> = 00 | Data<2:1> = 01 | Data<2:1> = 10 | Data<2:1> = 11 |
| 0 | 0 | 0 | 0 | 0 | 0 | VP0 | VP1 | VP2 | VP3 |
| | | | | | | VP4 | VP5 | VP6 | VP7 |
| 0 | 0 | 0 | 0 | 0 | 0 | VP8 | VP9 | VP10 | VP11 |
| | | | | | | VP12 | VP13 | VP14 | VP15 |
| 0 | 0 | 0 | 0 | 0 | 1 | VP16 | VP17 | VP18 | VP19 |
| | | | | | | VP20 | VP21 | VP22 | VP23 |
| 0 | 0 | 0 | 0 | 0 | 1 | VP24 | VP25 | VP26 | VP27 |
| | | | | | | VP28 | VP29 | VP30 | VP31 |
| 0 | 0 | 0 | 0 | 1 | 0 | VP32 | VP33 | VP34 | VP35 |
| | | | | | | VP36 | VP37 | VP38 | VP39 |
| 0 | 0 | 0 | 0 | 1 | 0 | VP40 | VP41 | VP42 | VP43 |
| | | | | | | VP44 | VP45 | VP45 | VP47 |
| 0 | 0 | 0 | 0 | 1 | 1 | VP48 | VP49 | VP50 | VP51 |
| | | | | | | VP52 | VP53 | VP54 | VP55 |
| 0 | 0 | 0 | 0 | 1 | 1 | VP56 | VP57 | VP58 | VP59 |
| | | | | | | VP60 | VP61 | VP62 | VP63 |
| . | . | . | . | . | . | . | . | . | . |
| . | . | . | . | . | . | . | . | . | . |
| . | . | . | . | . | . | . | . | . | . |
| 1 | 1 | 1 | 1 | 0 | 0 | VP960 | VP961 | VP962 | VP963 |
| | | | | | | VP964 | VP965 | VP966 | VP967 |
| 1 | 1 | 1 | 1 | 0 | 0 | VP968 | VP969 | VP970 | VP971 |
| | | | | | | VP972 | VP973 | VP974 | VP975 |
| 1 | 1 | 1 | 1 | 0 | 1 | VP976 | VP977 | VP978 | VP979 |
| | | | | | | VP980 | VP981 | VP982 | VP983 |
| 1 | 1 | 1 | 1 | 0 | 1 | VP984 | VP985 | VP986 | VP987 |
| | | | | | | VP988 | VP989 | VP990 | VP991 |
| 1 | 1 | 1 | 1 | 1 | 0 | VP992 | VP993 | VP994 | VP995 |
| | | | | | | VP996 | VP997 | VP998 | VP999 |

TABLE 2-continued

| | | | | | | | | | |
|---|---|---|---|---|---|---|---|---|---|
| 1 | 1 | 1 | 1 | 1 | 0 | VP1000 | VP1001 | VP1002 | VP1003 |
| | | | | | | VP1004 | VP1005 | VP1006 | VP1007 |
| 1 | 1 | 1 | 1 | 1 | 1 | VP1008 | VP1009 | VP1010 | VP1011 |
| | | | | | | VP1012 | VP1013 | VP1014 | VP1015 |
| 1 | 1 | 1 | 1 | 1 | 1 | VP1016 | VP1017 | VP1018 | VP1019 |
| | | | | | | VP1020 | VP1021 | VP1022 | VP1023 |

As shown in Table 2, the voltages VD1 to VD3 respectively output by the first to third decoders 30322, 30324, and 30326 correspond to the bit values from the fourth bit to the tenth bit from among the 10-bit digital video signal DAT. That is, when the bit value from the fourth bit to the tenth bit of the digital video signal DAT is given as "0000000," the voltages VD1 to VD3 respectively become VP7, VP3, and VP(−1), and when the bit value from the fourth bit to the tenth bit of the digital video signal DAT is "1111111," the voltages VD1 to VD3 respectively become VP1015, VP1019, and VP1023.

The number of switches included in the digital to analog (D/A) converter 303 and the output voltage amplifier 304 according to the first exemplary embodiment of the present invention are as follows.

The number of switches included in the first decoder 30322 is 126 ($=2^7-2$), and the number of switches included in each of the second decoder 30324 and the third decoder 30326 is 254 ($=2^8-2$). The number of switches included in the selected voltage output unit 30328 is 10, and the number of switches included in the output voltage generator 3034 is 7 ($=2*2^2-1$).

That is, the total number of switches included in the digital to analog (D/A) converter 303 and the output voltage amplifier 304 according to the first exemplary embodiment of the present invention is 651 (=126+254+254+10+7), which is very much less than the 2046 switches used for the decoder shown in FIG. 1. Therefore, realization cost and area for the liquid crystal display (LCD) are reduced.

The VP(−1) generated by the reference grayscale voltage generator 400 is used to generate all gray voltages corresponding to the digital video signal DAT input by the latch 302 by combining the voltages (VH, VL) that are generated by using the digital to analog (D/A) converter 303 according to the first exemplary embodiment of the present invention.

That is, in Table 2, there is a voltage difference by the gray level 4 between the high voltage VH and the low voltage VL output by the selected voltage output unit 30328. The output voltage generator 3034 and the output voltage amplifier 304 use the high voltage VH and the low voltage VL to generate the high voltage VH and the low voltage VL or a voltage between the high voltage VH and the low voltage VL as a gray voltage, and apply it to the data line through the output buffer 305. For example, in Table 2, when the digital video signal DAT is given as "00000000XX" (here, X is 0 or 1), the high voltage VH and the low voltage VL respectively become VP3 and VP(−1), and the gray voltage applied to the data line becomes one of VP0, VP1, VP2, and VP3 that are generated by combining VP3 and VP(−1) according to the bit values of two low bits of the digital video signal DAT.

The first to third decoders 30322, 30324, and 30326 according to the first exemplary embodiment of the present invention shown in FIG. 8 to FIG. 10 show decoders that are driven by receiving $2^{10}$ gray voltages VP0 to VP1023 and VP(−1) from the reference grayscale voltage generator 400. When the reference grayscale voltage generator 400 is set to generate VP$2^m$ other than VP(−1), the gray voltage applied to the data line becomes one of VP0, VP1, VP2, and VP3 that are generated by combining VP4 and VP0 according to the bit values of the two low bits of the digital video signal DAT in a like manner of the case in which the reference grayscale voltage generator 400 generates VP(−1), and it is thus driven in the same way. For this, the gray voltages input to the first to third decoders 30322, 30324, and 30326 from the reference grayscale voltage generator 400 must be different, which will now be described with reference to FIG. 15 to FIG. 17.

Figure 15:
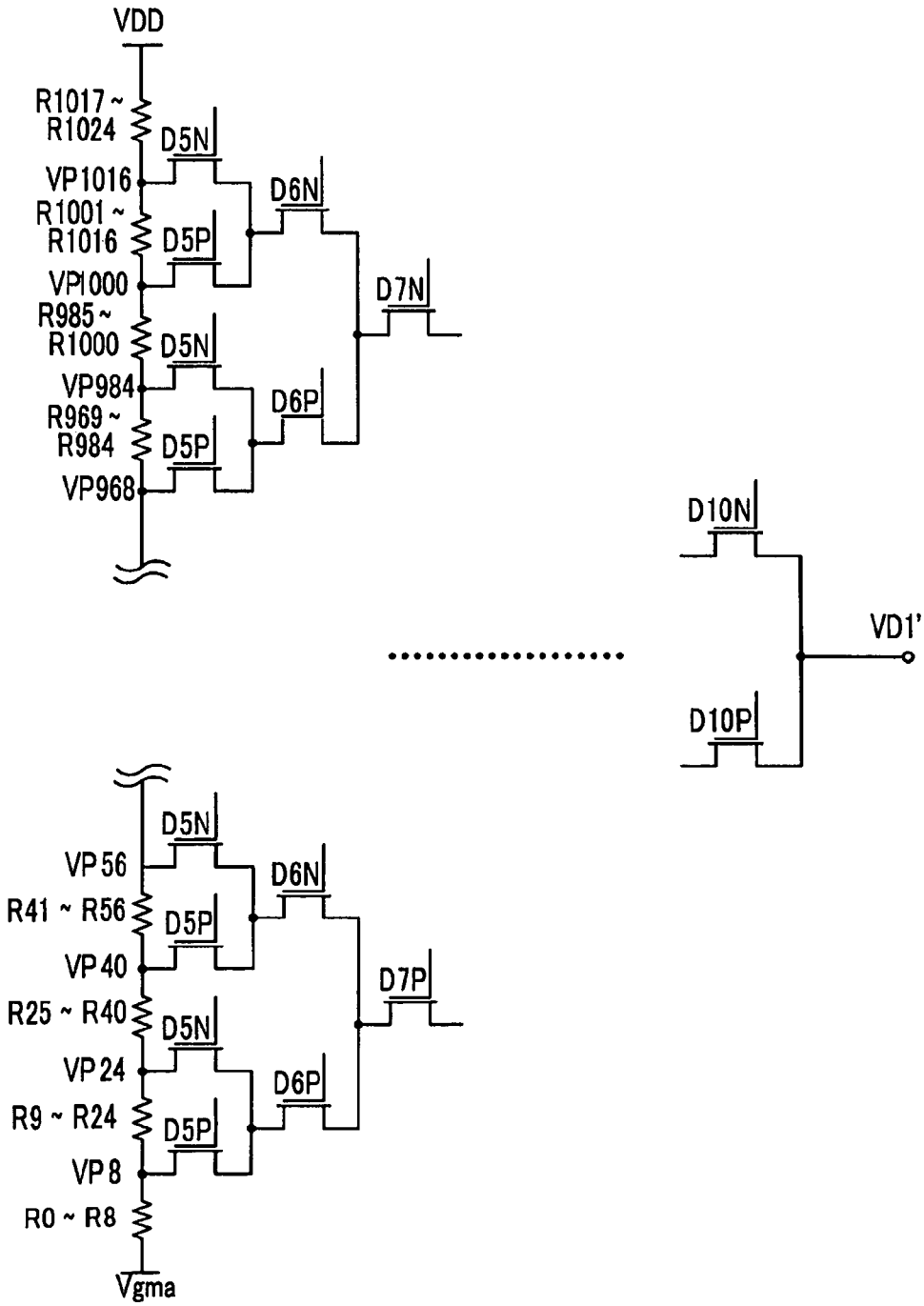
FIG. 15 shows a first decoder (30322') according to a second exemplary embodiment of the present invention.
Figure 16:
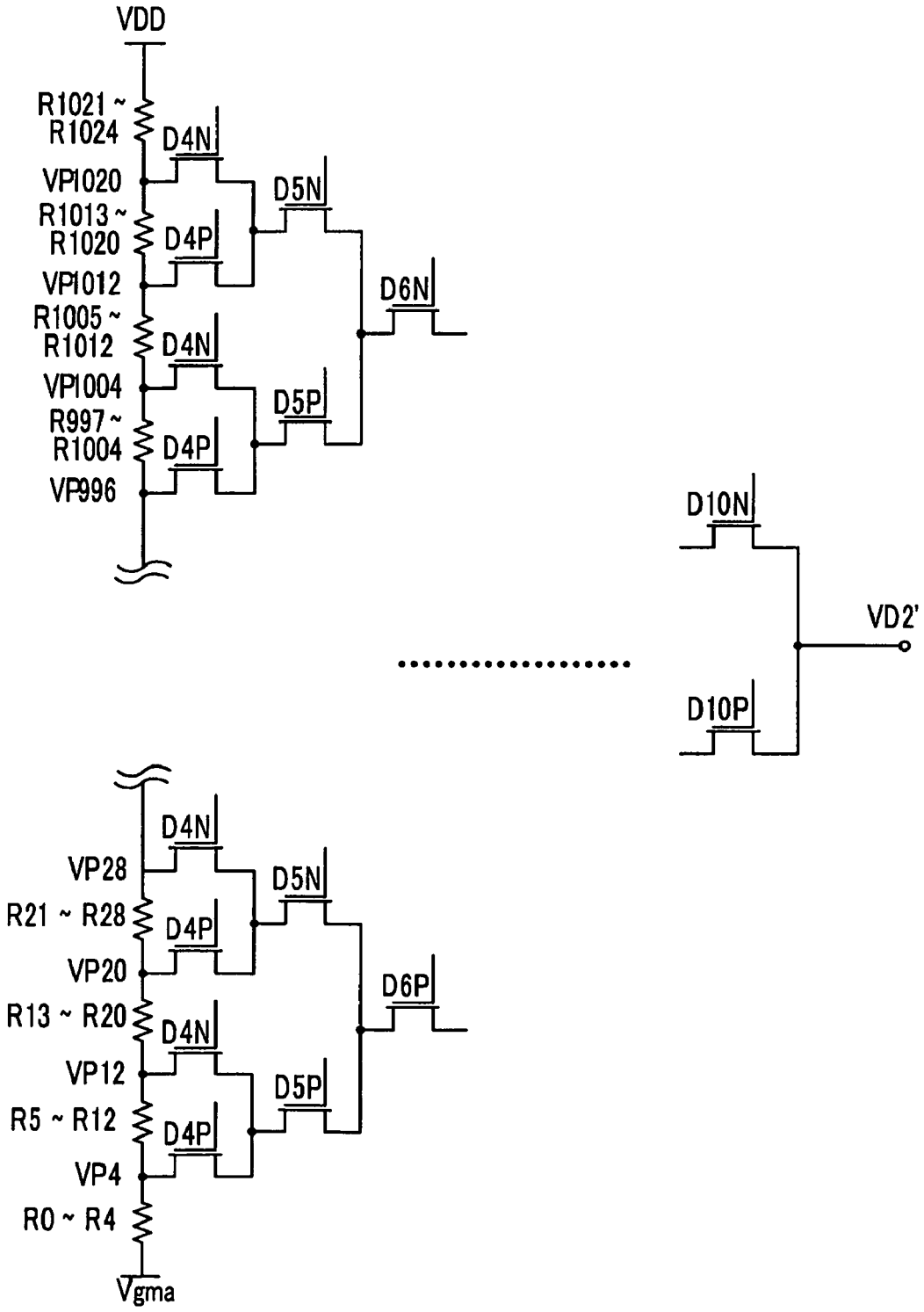
FIG. 16 shows a second decoder (30324') according to a second exemplary embodiment of the present invention.
Figure 17:
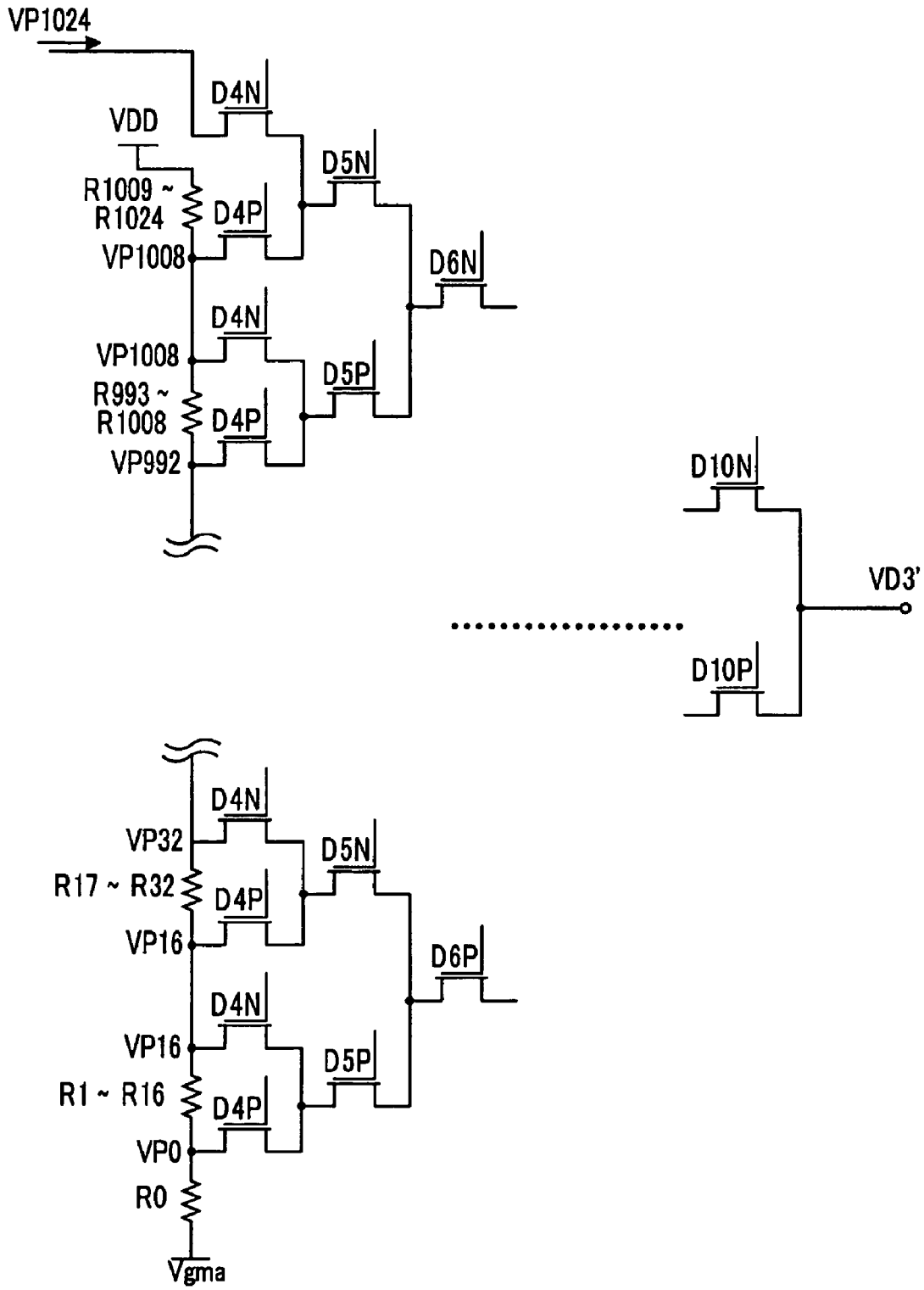
FIG. 17 shows a third decoder (30326') according to a second exemplary embodiment of the present invention.

In FIG. 15 to FIG. 17, VP0, VP4, VP8, . . . , VP1008, VP1012, VP1016, and VP1020 respectively indicate one of $2^{10}$ gray voltages VP0 to VP1023 that are generated by partially pressuring the voltage VDD with $2^{10}+1$ resistors R1 to R1024 from the voltage Vgma from among the reference gray voltages Vcom to VDD that are input by the reference grayscale voltage generator 400. Here, the voltage Vgma is greater than the common voltage Vcom by a predetermined level in a like manner of the first to third decoders 30322, 30324, and 30326 according to the first exemplary embodiment of the present invention shown in FIG. 8 to FIG. 10. In FIG. 15 to FIG. 17, the switches D4N, D4P, D5N, D5P, D6N, D6P, . . . , D10N, and D10P included in first to third decoders 30322', 30324', and 30326' according to the second exemplary embodiment of the present invention are formed with the same type of switches, that is, P-type field effect transistors. The switches D4N, D4P, D5N, D5P, D6N, D6P, . . . , D10N, and D10P can be formed with N-type field effect transistors, and in this instance, signals that are input to the switches D4N, D4P, D5N, D5P, D6N, D6P, . . . , D10N, and D10P must be inverted. Also, in FIG. 15 to FIG. 17, DION and D10P represent switches that are turned on/off by the bit value of the tenth bit which is the highermost bit and the inversion signal of the bit value of the tenth bit from among the 10-bit digital video signal DAT. Likely, D6N, D5N, and D4N represent the switches that are turned on/off by the bit values of the sixth bit, the fifth bit, and the fourth bit from among the 10-bit digital video signal DAT, and D6P, D5P, and D4P represent the switches that are turned on/off by inversion signals of the bit values of the sixth bit, the fifth bit, and the fourth bit from among the 10-bit digital video signal DAT.

FIG. 15 shows a first decoder 30322' according to a second exemplary embodiment of the present invention, and FIG. 16 shows a second decoder 30324' according to the second exemplary embodiment of the present invention.

As shown in FIG. 15, the first decoder 30322' according to an exemplary embodiment of the present invention receives 6 bits from the fifth bit to the tenth bit, selects one gray voltage from among VP8 to VP1016 according to the bit values of the input bits, and outputs it as the voltage VD1'. Here, the first decoder 30322' receives 64 ($=2^6$) gray voltages having the gray level difference of 16 starting from VP8, that is, VP8, VP24, VP40, VP56, . . . , VP968, VP984, VP1000, and VP1016. Accordingly, the number of switches included in the first decoder 30322' is $2^7-2$ ($=2^6+2^5+2^4+2^3+2^2 2^1$) which corresponds to the number of switches included in the first decoder 30322 according to the first exemplary embodiment of the present invention shown in FIG. 8.

As shown in FIG. 16, the second decoder 30324 according to the exemplary embodiment of the present invention receives 7 bits from the fourth bit to the tenth bit, selects one gray voltage from among VP4 to VP1020 according to the bit values of the input bits, and outputs it as the voltage VD2'. Here, the second decoder 30324 receives 128 ($=2^7$) gray voltages having the gray level difference of 8 starting from VP4, that is, VP4, VP12, VP20, VP28, . . . , VP996, VP1004, VP1012 and VP1020. Accordingly, the number of switches included in the second decoder 30324 is $2^8-2$ ($=2^7+2^6+2^5+2^4+2^3+2^2+2^1$) which corresponds to the number of switches included in the second decoder 30324 according to the first exemplary embodiment of the present invention shown in FIG. 9.

FIG. 17 shows a third decoder 30326' according to the second exemplary embodiment of the present invention.

In FIG. 17, VP1024 is a voltage input by the reference grayscale voltage generator 400, it is less than VDD, and it is defined as Equation 10.

$$VP1021=VP1020+(VP1024-VP1020)*(1/4) \quad \text{(Equation 10)}$$

That is, VP1024 is greater than VP1023 by VP1023−VP1022.

For reference, VP(−1) and VP1024 defined by Equation 1 and Equation 10 are not included in the $2^{10}$ gray voltages VP0 to VP1023 that can be generated by partial pressure with $2^{10}+1$ resistors R1 to R1024. Particularly, VP1024 is acquired by substituting m=10 for $VP2^m$ generated by the reference grayscale voltage generator 400.

As shown in FIG. 17, the third decoder 30326' according to the second exemplary embodiment of the present invention receives 7 bits from the fourth bit to the tenth bit, selects one gray voltage from among VP0 to VP1024 according to the bit values of the input bits, and outputs it as the voltage VD3'. Here, the third decoder 30326' receives 128 ($=2^7$) gray voltages having the gray level difference of 16 starting from VP0, that is, VP0, VP16, VP32, . . . , VP992 and VP1008 and VP1024, and is configured to receive the voltages except the lowest voltage VP0 and the highest voltage VP1024 from among the input gray voltages through two switches. Accordingly, the number of switches included in the third decoder 30326' according to the second exemplary embodiment of the present invention corresponds to $2^8-2$ ($=2^7+2^6+2^5+2^4+2^3+2^2+2^1$) in a like manner of the third decoder 30326 according to the first exemplary embodiment of the present invention shown in FIG. 10.

Here, the relationship among the lowest voltages that are respectively input to the first to third decoders 30322', 30324', and 30326' according to the second exemplary embodiment of the present invention is as follows. That is, the lowest voltage VP8 input to the first decoder 30322' is set to be greater than the lowest voltage VP4 input to the second decoder 30324' by the gray level of 4, and the lowest voltage VP0 input to the third decoder 30326' is set to be less than the lowest voltage VP4 input to the second decoder 30324' by the gray level of 4. Also, the voltages VD1' to VD3' that are output by the first to third decoders 30322', 30324', and 30326' according to the second exemplary embodiment of the present invention have the voltage difference by the gray level 4 in correspondence to the bit values of the 7 bits from the fourth bit to the tenth bit of the digital video signal DAT.

The output voltage generator 3034 according to the first exemplary embodiment of the present invention shown in FIG. 12 is set to satisfy the high and low voltages (VH, VL) output by the high and low voltage generator 3032 including the first to third decoders 30322, 30324, and 30326 according to the first exemplary embodiment of the present invention. In the case of using the first to third decoders 30322', 30324', and 30326' according to the second exemplary embodiment of the present invention shown in FIG. 15 to FIG. 17, the configuration of the output voltage generator 3034 is to be changed, which will now be described with reference to FIG. 18.

Figure 18:
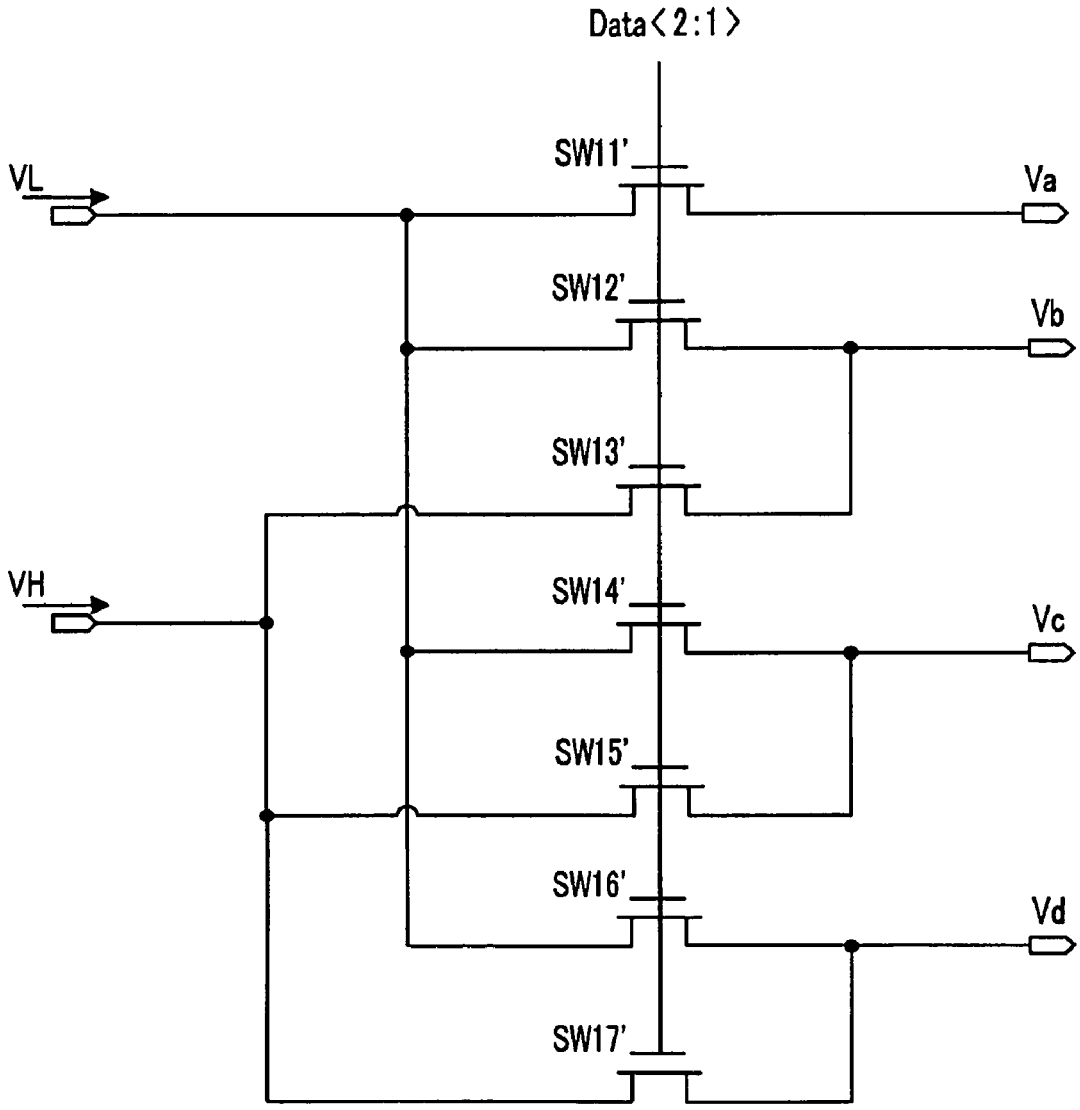
FIG. 18 shows an output voltage generator (3034') according to a second exemplary embodiment of the present invention.

FIG. 18 shows an output voltage generator 3034' according to a second exemplary embodiment of the present invention.

As shown in FIG. 18, the output voltage generator 3034' according to the second exemplary embodiment of the present invention includes a plurality of switches SW11' to SW17', and outputs four voltages Va, Vb, Vc, and Vd that are generated by using the high voltage and the low voltage input by the selected voltage output unit 30328 to the output voltage amplifier 304.

The switches SW12' to SW17' are turned on/off by the bit values of two bits except the 8 high bits used by the high and low voltage generator 3032 from among the 10-bit digital video signal DAT input by the latch 302, that is, the first bit and the second bit. The switch SW11' is always maintained in the turned on state.

In detail, the switch SW11' transmits the low voltage VL input to one terminal to a first voltage output terminal. The switch SW12' is turned on when the bit values of the first and second bits are "00", "01", and "10," and it transmits the low voltage VL input to one terminal to a second voltage output terminal. The switch SW13' is turned on when the bit value of the first and second bits is "11," and it transmits the high voltage VH input to one terminal to the second voltage output terminal. The switch SW14' is turned on when the bit values of the first and second bits are "00" and "01," and it transmits the low voltage VL input to one terminal to the third voltage output terminal. The switch SW15' is turned on when the bit values of the first and second bits are "10" and "11," and it transmits the high voltage VH input to one terminal to the third voltage output terminal. The switch SW16' is turned on when the bit value of the first and second bits is "00," and it transmits the low voltage VL input to one terminal to the fourth voltage output terminal. The switch SW17' is turned on when the bit values of the first and second bits are "01", "10", and "11," and it transmits the high voltage VH input to one terminal to the fourth voltage output terminal.

In FIG. 18, the four voltages Va, Vb, Vc, and Vd generated by the output voltage generator 3034' according to the second exemplary embodiment of the present invention are determined to be one ⑤ to ⑧.

⑤ When the bit values of the first and second bits are "0," Va=Vb=Vc=Vd=low voltage VL.

⑥ When the first bit is "1" and the second bit is "0," Va=Vb=Vc=low voltage VL, and Vd=high voltage VH.

⑦ When the first bit is "0" and the second bit is "1," Va=Vb=low voltage VL, and Vc=Vd=high voltage VH.

⑧ When the bit values of the first and second bits are "1," Va=low voltage VL, and Vb=Vc=Vd=high voltage VH.

In this instance, for the respective four cases ⑤ to ⑧, the output voltage Vout of the output voltage amplifier 304 according to the exemplary embodiment of the present invention shown in FIG. 13 is the combined value of the high voltage VH and the low voltage VL as shown by m) to p).

m) If Va=Vb=Vc=Vd=low voltage VL,
then, output voltage Vout=low voltage VL.

n) If Va=Vb=Vc=low voltage VL, and Vd=high voltage VH,
then, output voltage Vout=low voltage VL+(Δ/4)*high voltage VH.

o) If Va=Vb=low voltage VL, and Vc=Vd=high voltage VH,
then, output voltage Vout=low voltage VL+(2Δ/4)*high voltage VH.

p) If Va=low voltage VL, and Vb=Vc=Vd=high voltage VH,
then, output voltage Vout=low voltage VL+(3Δ/4)*high voltage VH.

For example, when the digital video signal DAT is given as "0000000001," the voltages VD1' to VD3' that are respectively output by the first to third decoders 30322, 30324, and 30326' respectively become VP8, VP4, and VP0, and the high voltage VH and the low voltage VL output by the selected voltage output unit 30328 become VP4 and VP0. In this instance, since Va, Vb, and Vc from among the four voltages Va, Vb, Vc, and Vd output by the output voltage generator 3034 all become VP0, and Vd becomes VP4, it corresponds to the case f), and hence, the output voltage Vout becomes VP0+(Δ/4)*VP4. Here, since the voltage difference Δ between the high voltage VH and the low voltage VL is VP4−VP0, Δ/4 is equal to VP1−VP0, and the output voltage Vout becomes VP1.

Table 3 shows output voltages Vout of the output voltage amplifier 304 corresponding to the digital video signal DAT when the high and low voltage generator 3032 including the third decoder 30326' according to the second exemplary embodiment of the present invention and the output voltage generator 3034' according to the second exemplary embodiment of the present invention is used. For reference, in Table 3, Data<10:5>, Data<4>, Data<3>, and Data<2:1> represent the bit values from the tenth bit to the fifth bit, the bit value of the fourth bit, the bit value of the third bit, and the bit values of the second bit and the first bit from among the 10-bit digital video signal DAT.

TABLE 3

| Data<10:5> | | | | | | Data<4> | VD1' | VD2' | VD3' | Data<3> | VL | VH |
|---|---|---|---|---|---|---|---|---|---|---|---|---|
| 0 | 0 | 0 | 0 | 0 | 0 | 0 | VP8 | VP4 | VP0 | 0 | VP0 | V4 |
| | | | | | | | | | | 1 | VP4 | V8 |
| 0 | 0 | 0 | 0 | 0 | 0 | 1 | VP8 | VP12 | VP16 | 0 | VP8 | V12 |
| | | | | | | | | | | 1 | VP12 | V16 |
| 0 | 0 | 0 | 0 | 0 | 1 | 0 | VP24 | VP20 | VP16 | 0 | VP16 | V20 |
| | | | | | | | | | | 1 | VP20 | V24 |
| 0 | 0 | 0 | 0 | 0 | 1 | 1 | VP24 | VP28 | VP32 | 0 | VP24 | V28 |
| | | | | | | | | | | 1 | VP28 | V32 |
| 0 | 0 | 0 | 0 | 1 | 0 | 0 | VP40 | VP36 | VP32 | 0 | VP32 | V36 |
| | | | | | | | | | | 1 | VP36 | V40 |
| 0 | 0 | 0 | 0 | 1 | 0 | 1 | VP40 | VP44 | VP48 | 0 | VP40 | V44 |
| | | | | | | | | | | 1 | VP44 | V48 |
| 0 | 0 | 0 | 0 | 1 | 1 | 0 | VP56 | VP52 | VP48 | 0 | VP48 | V52 |
| | | | | | | | | | | 1 | VP52 | V56 |
| 0 | 0 | 0 | 0 | 1 | 1 | 1 | VP56 | VP60 | VP64 | 0 | VP56 | V60 |
| | | | | | | | | | | 1 | VP60 | V64 |
| . | . | . | . | . | . | . | . | . | . | . | . | . |
| . | . | . | . | . | . | . | . | . | . | . | . | . |
| . | . | . | . | . | . | . | . | . | . | . | . | . |
| 1 | 1 | 1 | 1 | 0 | 0 | 0 | VP968 | VP964 | VP960 | 0 | VP960 | VP964 |
| | | | | | | | | | | 1 | VP964 | VP968 |
| 1 | 1 | 1 | 1 | 0 | 0 | 1 | VP968 | VP972 | VP976 | 0 | VP968 | VP972 |
| | | | | | | | | | | 1 | VP972 | VP976 |
| 1 | 1 | 1 | 1 | 0 | 1 | 0 | VP984 | VP980 | VP976 | 0 | VP976 | VP980 |
| | | | | | | | | | | 1 | VP980 | VP984 |
| 1 | 1 | 1 | 1 | 0 | 1 | 1 | VP984 | VP988 | VP992 | 0 | VP984 | VP988 |
| | | | | | | | | | | 1 | VP988 | VP992 |
| 1 | 1 | 1 | 1 | 1 | 0 | 0 | VP1000 | VP996 | VP992 | 0 | VP992 | VP996 |
| | | | | | | | | | | 1 | VP996 | VP1000 |
| 1 | 1 | 1 | 1 | 1 | 0 | 1 | VP1000 | VP1004 | VP1008 | 0 | VP1000 | VP1004 |
| | | | | | | | | | | 1 | VP1004 | VP1008 |
| 1 | 1 | 1 | 1 | 1 | 1 | 0 | VP1016 | VP1012 | VP1008 | 0 | VP1008 | VP1012 |
| | | | | | | | | | | 1 | VP1012 | VP1016 |
| 1 | 1 | 1 | 1 | 1 | 1 | 1 | VP1016 | VP1020 | VP1024 | 0 | VP1016 | VP1020 |
| | | | | | | | | | | 1 | VP1020 | VP1024 |

| | | | | | | Vout | | | |
|---|---|---|---|---|---|---|---|---|---|
| Data<10:5> | | | | | | Data<2:1> = 00 | Data<2:1> = 01 | Data<2:1> = 10 | Data<2:1> = 11 |
| 0 | 0 | 0 | 0 | 0 | 0 | V1 | V2 | V3 | V0 |
| | | | | | | V5 | V6 | V7 | V4 |
| 0 | 0 | 0 | 0 | 0 | 0 | V9 | V10 | V11 | V8 |
| | | | | | | V13 | V14 | V15 | V12 |
| 0 | 0 | 0 | 0 | 0 | 1 | V17 | V18 | V19 | V16 |
| | | | | | | V21 | V22 | V23 | V20 |
| 0 | 0 | 0 | 0 | 0 | 1 | V25 | V26 | V27 | V24 |
| | | | | | | V29 | V30 | V31 | V28 |
| 0 | 0 | 0 | 0 | 1 | 0 | V33 | V34 | V35 | V32 |
| | | | | | | V37 | V38 | V39 | V36 |
| 0 | 0 | 0 | 0 | 1 | 0 | V41 | V42 | V43 | V40 |
| | | | | | | V45 | V46 | V47 | V44 |
| 0 | 0 | 0 | 0 | 1 | 1 | V49 | V50 | V51 | V48 |
| | | | | | | V53 | V54 | V55 | V52 |
| 0 | 0 | 0 | 0 | 1 | 1 | V57 | V58 | V59 | V56 |
| | | | | | | V61 | V62 | V63 | V60 |
| . | . | . | . | . | . | . | . | . | . |
| . | . | . | . | . | . | . | . | . | . |
| . | . | . | . | . | . | . | . | . | . |

TABLE 3-continued

| | | | | | | | | | |
|---|---|---|---|---|---|---|---|---|---|
| 1 | 1 | 1 | 1 | 0 | 0 | VP961 | VP962 | VP963 | VP960 |
| | | | | | | VP965 | VP966 | VP967 | VP964 |
| 1 | 1 | 1 | 1 | 0 | 0 | VP969 | VP970 | VP971 | VP968 |
| | | | | | | VP973 | VP974 | VP975 | VP972 |
| 1 | 1 | 1 | 1 | 0 | 1 | VP977 | VP978 | VP979 | VP976 |
| | | | | | | VP981 | VP982 | VP983 | VP980 |
| 1 | 1 | 1 | 1 | 0 | 1 | VP985 | VP986 | VP987 | VP984 |
| | | | | | | VP989 | VP990 | VP991 | VP988 |
| 1 | 1 | 1 | 1 | 1 | 0 | VP993 | VP994 | VP995 | VP992 |
| | | | | | | VP997 | VP998 | VP999 | VP996 |
| 1 | 1 | 1 | 1 | 1 | 0 | VP1001 | VP1002 | VP1003 | VP1000 |
| | | | | | | VP1005 | VP1006 | VP1007 | VP1004 |
| 1 | 1 | 1 | 1 | 1 | 1 | VP1009 | VP1010 | VP1011 | VP1008 |
| | | | | | | VP1013 | VP1014 | VP1015 | VP1012 |
| 1 | 1 | 1 | 1 | 1 | 1 | VP1017 | VP1018 | VP1019 | VP1016 |
| | | | | | | VP1021 | VP1022 | VP1023 | VP1020 |

As expressed in Table 3, the voltages VD1' to VD3' output by the first to third decoders 30322', 30324', and 30326' correspond to the bit values from the fourth bit to the tenth bit from among the 10-bit digital video signal DAT. That is, when the bit values from the fourth bit to the tenth bit of the digital video signal DAT is "0000000," the voltages VD1' to VD3' become VP8, VP4, and VP0, and when the bit values from the fourth bit to the tenth bit of the digital video signal DAT is "1111111," the voltages VD1' to VD3' become VP1016, VP1020, and VP1024, respectively.

The number of switches included in the digital to analog (D/A) converter 303 according to the first exemplary embodiment of the present invention is less than that of the general decoder shown in FIG. 1, and the number of switches included in the digital to analog (D/A) converter 303 and the output voltage amplifier 304 according to the first exemplary embodiment of the present invention is as follows.

The number of switches included in the first decoder 30322' is 126 ($=2^7-2$), and the number of switches included in each of the second decoder 30324' and the third decoder 30326' is 254 ($=2^8-2$). The number of switches included in the selected voltage output unit 30328 is 10, and the number of switches included in the output voltage generator 3034' is 7 ($=2*2^2-1$).

That is, the entire number of switches included in the digital to analog (D/A) converter 303 and the output voltage amplifier 304 according to the first exemplary embodiment of the present invention is 651 (=126+254+254+10+7), and it includes very much lesser number of switches compared to the 2046 switches used in the general decoder shown in FIG. 1. Therefore, the realization cost and area for the liquid crystal display (LCD) can be reduced.

VP(−1) and VP$2^m$ generated by the reference grayscale voltage generator 400 are used to generate all gray voltages corresponding to the digital video signal DAT input by the latch 302 by combining the voltages (VH, VL) that are generated by using the digital to analog (D/A) converter 303 according to the first exemplary embodiment of the present invention.

When the first to third decoders according to the first and second exemplary embodiments of the present invention are realized by negative decoders, the first to third decoders are formed to output a negative voltage with reference to the common voltage Vcom, which is similar to the case of realizing them by positive decoders. When the reference grayscale voltage generator 400 supplies the reference gray voltages VSS to Vgma of the negative values VSS to Vcom and VN(−1) to the third decoder, the first to third decoders are formed in a structure similar to the first to third decoders according to the first exemplary embodiment of the present invention shown in FIG. 8 to FIG. 10. When the reference grayscale voltage generator 400 supplies the reference gray voltages VSS to Vgma of the negative values VSS to Vcom and VN$2^m$ to the third decoder, the first to third decoders are formed in a structure similar to the first to third decoders according to the first exemplary embodiment of the present invention shown in FIG. 14 to FIG. 16. In this instance, the voltage Vgma is less than the common voltage Vcom by a predetermined level.

The digital to analog (D/A) converter 303 and the output voltage amplifier 304 according to the first exemplary embodiment of the present invention are exemplified by specifying the bit number k of low-order bits used by the output voltage generator 3034 as 10 and 2 in order to generate the number m of the bits of the digital video signal DAT input by the latch 302 and voltage Vo. However, the number of bits m and k can be differently set, and the digital to analog (D/A) converter 303 and the output voltage amplifier 304 according to the first exemplary embodiment of the present invention will now be generalized without specifying the number of bits m and k.

First, the first decoders 30322 and 30322' receive (m−k−2) bits from the (m−k−3)-th bit to the m-th bit, select one of the $2^{m-k-2}$ gray voltages according to the bit values of the input bits, and output it as the voltages VD1 and VD1'. In this instance, the number of switches included in the first decoders 30322 and 30322' is $2^{m-k-1}-2$ ($=2^{m-k-2}+\ldots+2^2+2^1$).

The second decoders 30324 and 30324' receive (m−k−1) bits from the (m−k−2)-th bit to the m-th bit, select one of the $2^{m-k-1}$ gray voltages according to the bit values of the input bits, and output it as the voltages VD2 and VD2'. In this instance, the number of switches included in the second decoders 30324 and 30324' is $2^{m-k}-2$ ($=2^{m-k-1}+\ldots+2^2+2^1$).

The third decoders 30326 and 30326' receive (m−k−1) bits from the (m−k−2)-th bit to the m-th bit, select one of the $2^{m-k-1}$ gray voltages according to the bit values of the input bits, and output it as the voltages VD3 and VD3'. In this instance, the number of switches included in the third decoders 30326 and 30326' is $2^{m-k}-2$ ($=2^{m-k-1}+\ldots+2^2+2^1$).

One of the $2^{m-k-1}$ gray voltages input to the third decoders 30326 and 30326' is one of VP(−1), VN(−1), VP$2^m$, and VN$2^m$, VP(−1) or VP$2^m$ is supplied to the positive decoder, and VN(−1) or VN$2^m$ is supplied to the negative decoder as described above. Also, the minimum gray voltage input to the first to third decoders is varied depending on which one of the voltages VP(−1), VN(−1), VP$2^m$, and VN$2^m$ is generated by the reference grayscale voltage generator 400, which will not be described since it has already been described.

Here, generalization of VP$2^m$ and VN$2^m$ is expressed in Equations 11 and 12.

$$VP(2^m-3)=VP(2^m-4)+(VP2^m-VP(2^m-4))*(1/4) \quad \text{(Equation 11)}$$

$$VN(2^m-3)=VN(2^m-4)+(VN2^m+VN(2^m-4))*(1/4) \quad \text{(Equation 12)}$$

The $2^{m-k-2}$ gray voltages that are input to the first decoder have the gray level difference by $2^{k+2}$, and the $2^{m-k-1}$ gray voltages that are input to the second decoder have the gray level difference by $2^{k+1}$. The $2^{m-k-1}$ gray voltages that are input to the second decoder have the gray level difference by $2^{k+2}$.

Also, the gray voltages that are output by the first to third decoders will now be described.

The gray voltage output by the first decoders 30324 and 30324' is V($2^{(k+2)}$*X+C2), and the gray voltage output by the second decoders 30324 and 30324' is V($2^{(k+1)}$*Y+C1). Here, X is the value that is generated by converting the bit values of (m−k−2) bits from the (m−k−3)-th bit to the m-th bit from among the m-bit digital video signal DAT input by the latch 302 into a 10-ary number, and Y is the value that is generated by converting the bit values of (m−k−1) bits from the (m−k−2)-th bit to the m-th bit from among the m-bit digital video signal DAT input by the latch 302 into a 10-ary number.

The gray voltage output by the third decoders 30326 and 30326' is varied by the bit value of the (m−k−1)-th bit. That is, when the bit value of the (m−k−1)-th bit is "0," the gray voltage output by the third decoder 30326 becomes V($2^{(k+2)}$*X+C3), and when the bit value of the (m−k−1)-th bit is "1,", the gray voltage output by the third decoder 30326 becomes V($2^{(k+2)}$*X+C4). In this instance, the relationship among C1, C2, C3, and C4 is expressed in Equation 13.

$$|C2-C1|=2^k,$$

$$|C3-C1|=2^k,$$

$$|C3-C4|=2^{(k+2)},$$

$$|C2-C3|=2^{(k+1)}, \text{ if } C3<C4$$

$$|C2-C4|=2^{(k+1)}, \text{ if } C3>C4 \quad \text{(Equation 13)}$$

The selected voltage output unit 30328 according to the exemplary embodiment of the present invention shown in FIG. 11 is an exemplified one, and other types of circuits performing the same operation are also allowable. Here, the same operation is to select the voltages VD1 to VD3 that are input by the first to third decoders according to the bit value of the (m−k−2)-th bit, and output the same. That is, when the bit value of the (m−k−2)-th bit is "0," two voltages with a low voltage level are selected to be output from among the voltages VD1 to VD3, and when the bit value of the (m−k−2)-th bit is "1," two voltages with a high voltage level are selected to be output from among the voltages VD1 to VD3.

Further, the output voltage generators 3034 and 3034' are exemplified, and it is also possible to increase the number of voltage V0 to be greater than the four voltages Va, Vb, Vc, and Vd. That is, $2^k$ voltages are output according to the bit values of the k low-order bits from among the m bits, which will be generalized into the next two cases q and r.

q. In correspondence to the value s that is generated by converting the bit value of the k low-order bits into a 10-ary number, if s="0", there are $2^k$ low voltage outputs, if s="1", there is one high voltage and there are $2^k-1$ low voltage outputs, if s="2", there are two high voltages and ($2^k-2$) low voltage outputs, if s="$2^k-2$", there are ($2^k-2$) high voltages and two low voltage outputs, and if s="$2^k-1$", there are ($2^k-1$) high voltages VH and one low voltage VL output.

r. In correspondence to the value s that is generated by converting the bit values of the k low-order bits into a 10-ary number, if s="0", there is one high voltage and there are ($2^k-1$) low voltage outputs, if s="1", there are two high voltages and ($2^k-2$) low voltage outputs, if s="$2^k-3$", there are ($2^k-2$) high voltages and ($2^k-3$) low voltage outputs, if s="$2^k-2$", there are ($2^k-1$) high voltages VH and one low voltage VL output, and if s="$2^k-1$", there are $2^k$ high voltage outputs.

In this instance, the number of switches included in the output voltage generator is ($2*2^k$)−1. The number of transistors forming two input terminals of the output voltage amplifier 304 according to the exemplary embodiment of the present invention is formed to correspond to the number of output voltages of the output voltage generator. That is, when the number of output voltages of the output voltage generator is $2^k$, the number of switches of a first terminal and a second terminal of the output amplifier is to be $2^k$.

The voltage difference between the voltages VD1 to VD3 that are output by the first to third decoders 30322, 30324, and 30326 according to the first exemplary embodiment of the present invention are set to be 4 gray levels, and two voltages from among the voltages VD1 to VD3 are combined through the output voltage amplifier 304 to generate a middle voltage. This is also applicable to the case of using the first to third decoders 30322', 30324', and 30326' according to the second exemplary embodiment of the present invention. Accordingly, the data driver 300 according to the exemplary embodiment of the present invention can output all gray levels corresponding to the digital video signal DAT.

Resistance of the resistors R1 to R1024 are not the same, and particularly, the resistors that are formed near the power sources for supplying the voltage Vgma and the voltage VDD from among the resistors R1 to R1024 have a large resistance deviation compared to other resistors included in the resistors R1 to R1024. This is caused by following the characteristic of the liquid crystal display (LCD) panel 100 because the voltage deviation among the voltages VP0, VP1, VP2, . . . near the voltage Vgma and the voltage deviation among the voltages VP1023, VP1022, VP1021, . . . near the voltage VDD are set to be greater than the voltage deviation among other voltages included in the voltages VP0 to VP1023.

Because of the voltage deviations, a large voltage error can be generated between the middle voltage that is generated by combining the two voltages VL and VH having the voltage difference of 4 gray levels generated by using the digital to analog (D/A) converter 303 according to the first exemplary embodiment of the present invention through the output voltage amplifier 304 and the voltage to be actually output. A digital to analog (D/A) converter 303' for eliminating the voltage error generating factor according to a second exemplary embodiment of the present invention will now be described with reference to FIG. 19.

Hereinafter, it will be assumed that the digital video signal DAT input by the latch 302 has 10 bits, and that the low-order bits used by the output voltage generator 3034 for generating the voltage Vo from among the digital video signal DAT have 2 bits.

Figure 19:
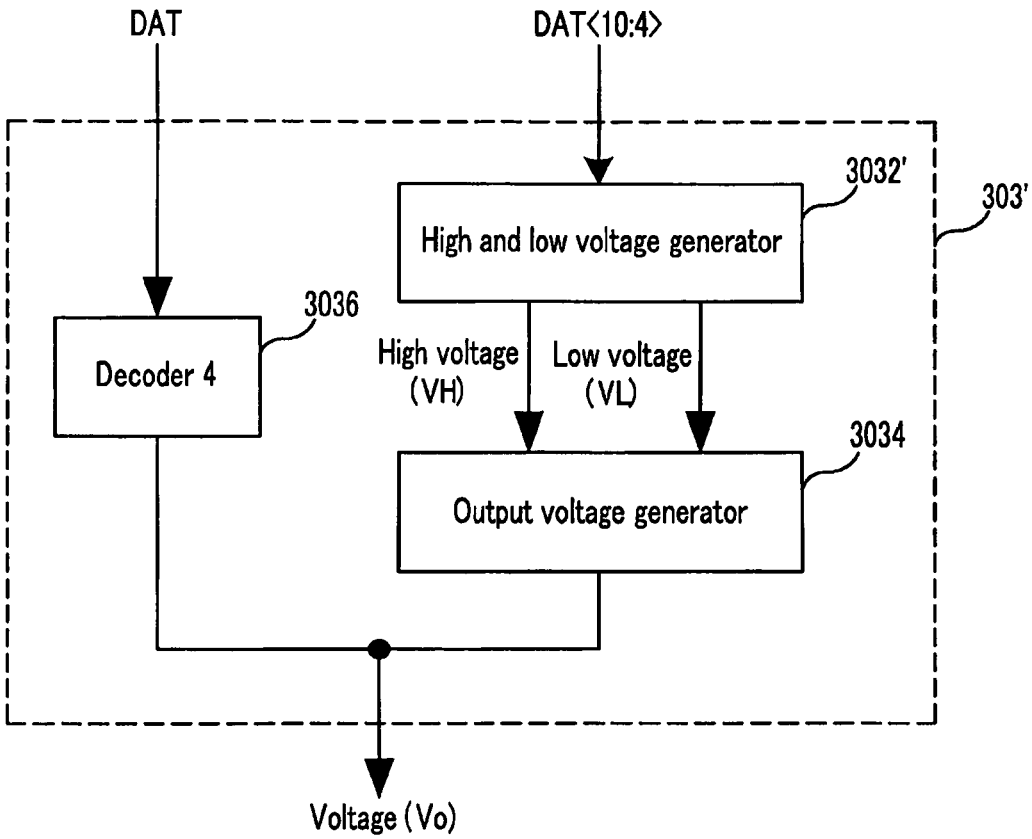
FIG. 19 shows a digital to analog (D/A) converter 303' according to a second exemplary embodiment of the present invention.

FIG. 19 shows a digital to analog (D/A) converter 303' according to a second exemplary embodiment of the present invention.

As shown in FIG. 19, the digital to analog (D/A) converter 303' according to the second exemplary embodiment of the present invention includes a high and low voltage generator 3032', an output voltage generator 3034, and a fourth decoder 3036. For reference, the output voltage generator 3034 is formed to be like the output voltage generator 3034 included in the digital to analog (D/A) converter 303 according to the first exemplary embodiment of the present invention, and hence, it has the same reference numeral and will not be described.

First, the fourth decoder 3036 receives the digital video signal DAT from the latch 302, and receives $2^n$ gray voltages having the gray level difference of 1 from VP0 to VP($2^n$−1) according to the bit value of the input bits. Here, n is a natural number equal to or greater than 2, and it must be set to be a natural number less than the number of bits of the digital video signal DAT.

Also, the fourth decoder 3036 is configured to include a switch that is turned on/off by the bit value of the number of bits corresponding to the size n from among the 10 bits, that is, all bits included in the digital video signal DAT.

The fourth decoder 3036 will be described assuming the n is given as "3" with reference to FIG. 20.

Figure 20:
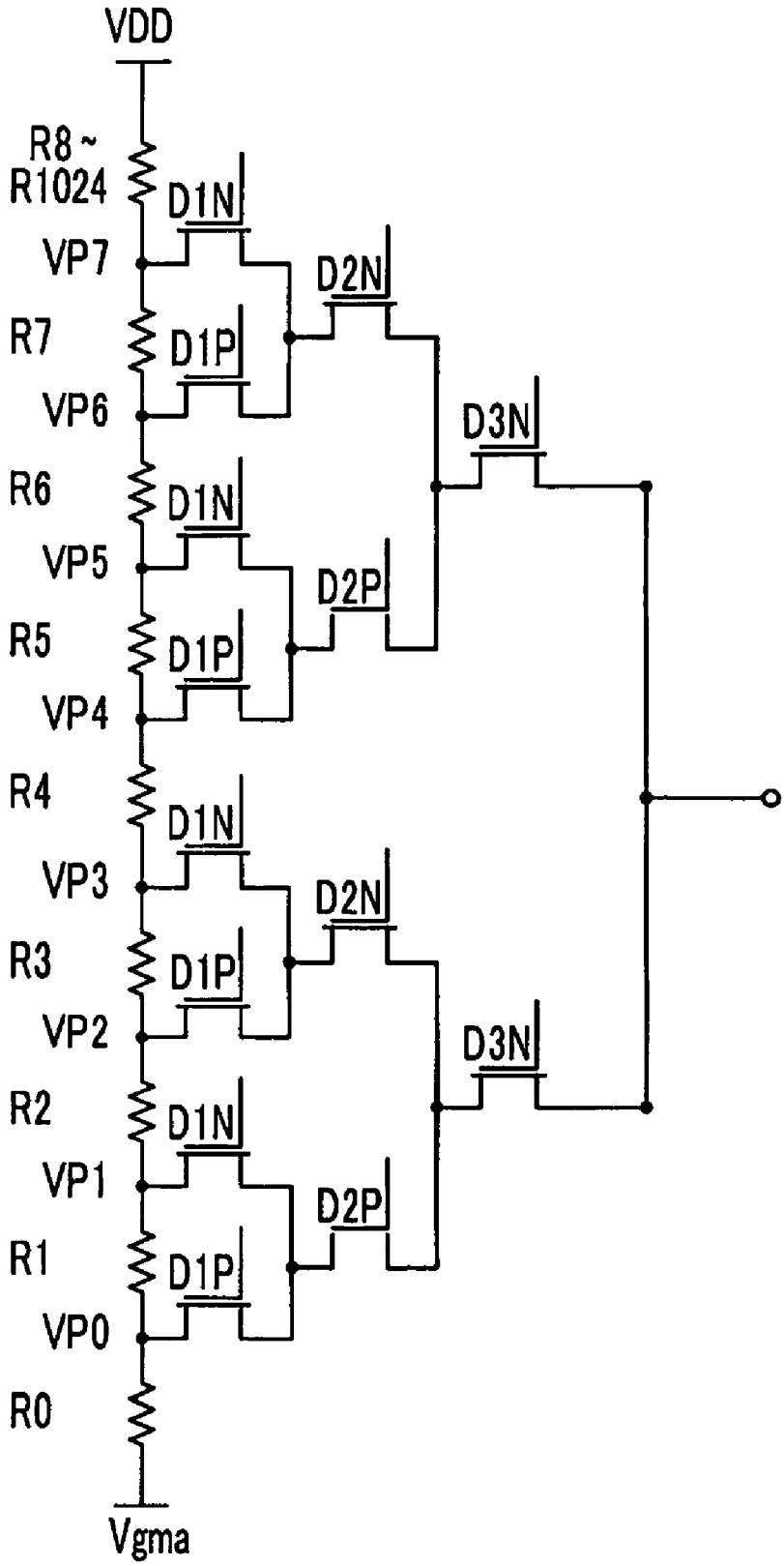
FIG. 20 shows a fourth decoder 3036 according to an exemplary embodiment of the present invention when n is given as 3.

In FIG. 20, VP0 to VP7 respectively indicate one of the $2^{10}$ gray voltages VP0 to VP1023 that are generated by partially pressuring the voltage VDD from the voltage Vgma with $2^{10}$+1 resistors R1 to R1024 from among the reference gray voltages Vcom to VDD input by the reference grayscale voltage generator 400. Here, the voltage Vgma is greater than the common voltage Vcom by a predetermined level in a like manner of the first to third decoders included in the digital to analog (D/A) converter 303 according to the first exemplary embodiment of the present invention. In FIG. 20, the switches D1N, D1P, D2N, D2P, D3N, and D3P included in the fourth decoder 3036 are the same type of switches, that is, P-type field effect transistors. The switches D1N, D1P, D2N, D2P, D3N, and D3P can alternatively be formed with the N-type field effect transistors, and in this instance, the signals that are input to the respective switches D1N, D1P, D2N, D2P, D3N, and D3P must be inverted. Also, in FIG. 20, D1N and D1P represent the switches that are turned on/off by the bit value of the first bit that is the lowermost bit from among the 10-bit digital video signal DAT and the inversion signal of the bit value of the first bit. In a like manner, D2N and D3N represent the switches that are turned on/off by the bit values of the second bit and the third bit from among the 10-bit digital video signal DAT, and D2P and D3P indicate the switches that are turned on/off by the inversion signals of the bit values of the second bit and the third bit from among the 10-bit digital video signal DAT.

FIG. 20 shows a fourth decoder 3036 according to an exemplary embodiment of the present invention when n is given as 3.

As shown in FIG. 20, the fourth decoder 3036 can be set to receive three bits from the first bit to the third bit from among the digital video signal DAT, and in this instance, the number of switches included in the fourth decoder 3036 is $2^4-2$ ($=2^3+2^2+2^1$).

The fourth decoder 3036 receives the gray voltages VP0 to VP7 with the gray level difference of 1, that is, 8 ($=2^3$) gray voltages VP0, VP1, VP2, . . . , VP6, VP7, and selectively outputs one of the gray voltages from among VP0 to VP7 according to the bit values of the three bits from the first bit to the third bit from among the digital video signal DAT.

A high and low voltage generator 3032' included in the digital to analog (D/A) converter 303' according to the second exemplary embodiment of the present invention will now be described with reference to FIG. 21.

Figure 21:
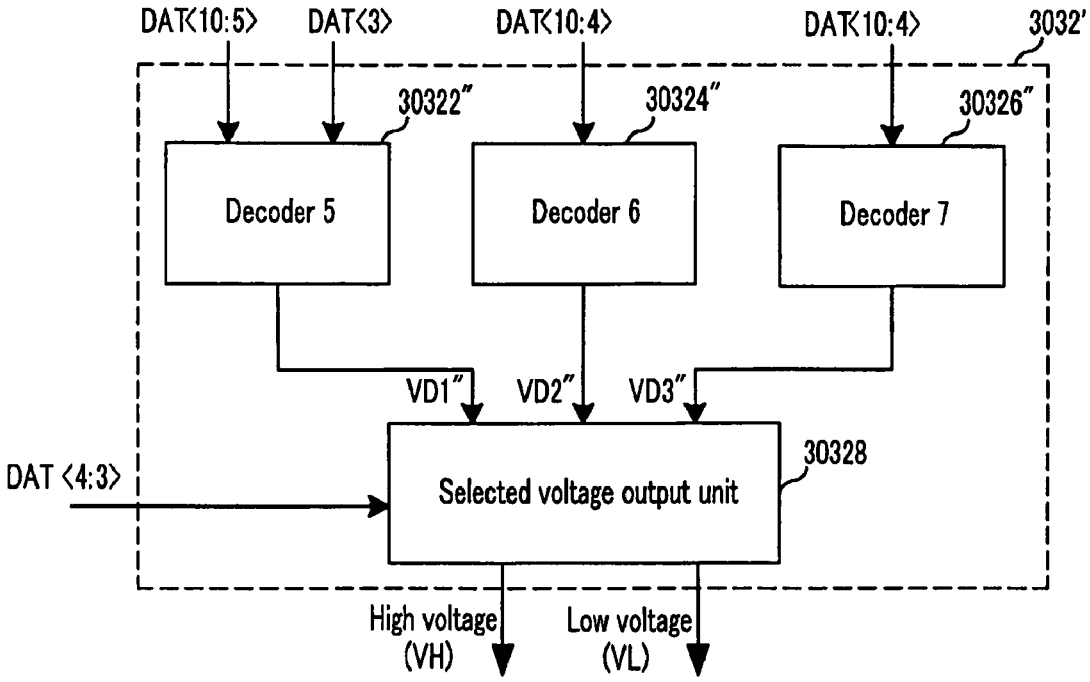
FIG. 21 shows a high and low voltage generator 3032' according to an exemplary embodiment of the present invention.

FIG. 21 shows a high and low voltage generator 3032' according to an exemplary embodiment of the present invention.

As shown in FIG. 21, the high and low voltage generator 3032' includes fifth to seventh decoders 30322", 30324", and 30326" and a selected voltage output unit 30328. For reference, since the selected voltage output unit 30328 is formed in a like manner of the selected voltage output unit 30328 included in the digital to analog (D/A) converter 303 according to the first exemplary embodiment of the present invention, it has the same reference numeral and no corresponding description will be provided.

The fifth to seventh decoders 30322" to 30226" are formed to be very similar to the first to third decoders 30322, 30324, and 30326 according to the first exemplary embodiment of the present invention shown in FIG. 8 to FIG. 10, and their differences will now be described.

The fifth decoder 30322" further includes a switch coupled to a node of the resistors R7 and R8 and one terminal of the switch D5P in the first decoder 30322 according to the first exemplary embodiment of the present invention shown in FIG. 8. The switch is turned off when the bit value of the third bit input to the fifth decoder 30322" from among the digital video signal DAT is "0," and it is turned on when the bit value is "1". Also, the sixth decoder 30324" is acquired by eliminating the switch D4P coupled to the node of the resistors R3 and R4 from the second decoder 30324 according to the first exemplary embodiment of the present invention shown in FIG. 9, and the seventh decoder 30326" is acquired by eliminating the switch D4P for receiving the voltage VP(−1) from the third decoder 30326 according to the first exemplary embodiment of the present invention shown in FIG. 10 so that the gray voltage input to the fourth decoder 3036 and the gray voltage input to the fifth to seventh decoders 30322" to 30226" may not be overlapped.

A digital to analog (D/A) converter) 303' according to the second exemplary embodiment of the present invention is operated as follows.

The fourth decoder 3036 outputs the gray voltage only when the bit value of at least one of the three bits from the first bit to the third bit from among the digital video signal DAT is "1". In this instance, the high and low voltage generator 3032' and the output voltage generator 3034 output no voltage, and hence, the output voltage of the fourth decoder 3036 becomes the output voltage V0 of the digital to analog (D/A) converter 303' according to the second exemplary embodiment of the present invention. On the contrary, when the bit values of the three bits from the first bit to the third bit from among the digital video signal DAT are "0," the fourth decoder 3036 outputs no gray voltage, and in this instance, the voltage output by the high and low voltage generator 3032' and the output voltage generator 3034 becomes the output voltage V0 of the digital to analog (D/A) converter 303' according to the second exemplary embodiment of the present invention.

VP7 from among the gray voltages is input in common to the fourth decoder 3036 and the fifth decoder 30322", which will now be described with reference to Table 2.

When the bit value of the fourth bit from among the digital video signal DAT is "1" and the bit values from the first to third bits are "0," the fourth decoder 3036 outputs no gray voltage. Therefore, the output voltage Vout is generated by combining the high and low voltages VH and VL that are generated by using the output voltages VD1" to VD3" of the fifth to seventh decoders 30322" to 30226". When VP7 is not input to the fifth decoder 30322", the voltage VD1" output by the fifth decoder 30322" cannot be VP7 when the bit value of the fourth bit of the digital video signal DAT is "1" and the bit value of the third bit is "0" in Table 2. Hence, as shown in Table 2, voltage combination using the high and low voltages VH and VL output by the high and low voltage generator 3032', that is, VP11 and VP7, cannot be performed, and the middle voltages VP8, VP9, and VP10 cannot be generated through voltage combination.

The fourth decoder 3036 can be set to receive the gray voltages having the gray level difference of 1 from VP1016 to VP1023, that is, 8 ($=2^3$) gray voltages VP1016, VP1017, VP1018, . . . , VP1022, and VP1023, and selectively output one gray voltage from among VP1016 to VP1023 according to the bit values of the three bits from the seventh bit to the tenth bit from among the digital video signal DAT. Also, the fourth decoder 3036 can be set to receive 8 specific voltages having the gray level difference of 1 from V0 to V1023, for example, 8 ($=2^3$) gray voltages VP511, VP512, VP513, VP517, and VP518, and selectively output one gray voltage from among VP511 to VP518 according to the bit value of the three bits from among the digital video signal DAT.

The gray voltage input in common to the fourth decoder 3036 and the fifth to seventh decoders 30322", 30324", and 30226" are used to generate a middle voltage through voltage combination, and the gray voltage input in common to the fourth decoder 3036 and the fifth decoder 30322" may not exist corresponding to the above-noted case, and the gray voltage input in common to the fourth decoder 3036 and the sixth decoder 30324" or the fourth decoder 3036 and the seventh decoder 30326" naturally exist.

Also, the digital to analog (D/A) converter 303' according to the second exemplary embodiment of the present invention may further include an eighth decoder (not shown). In this instance, the fourth decoder 3036 can be set to output gray voltages that correspond to the bit values of the three bits from the first bit to the third bit of the digital video signal DAT from among the 8 ($=2^3$) gray voltages VP0, VP1, VP2, . . . , VP6, and VP7, and the eighth decoder can be set to output gray voltages that correspond to the bit values of the three bits from the seventh bit to the tenth bit of the digital video signal DAT from among the 8 ($=2^3$) gray voltages VP1016, VP1017, VP1018, . . . , VP1022, and VP1023.

Also, the digital to analog (D/A) converter 303' according to the second exemplary embodiment of the present invention may further include a plurality of decoders (not shown), and in this case, the respective decoders can be set to output the gray voltages that correspond to the bit values of the three bits of the digital video signal DAT from among 8 specific voltages having the gray level difference of 1 from among V0 to V1023.

The fourth decoder 3036 with the assumption of n as "3" has been described.

Here, n is a natural number equal to or greater than 2, and it is set with the natural number that is less than the number of bits of the digital video signal DAT.

First, the fourth decoder 3036 receives the digital video signal DAT from the latch 302, and receives $2^n$ gray voltages with the gray level difference of 1 from VP0 to VP ($2^n-1$) according to the bit value of the input bits. Here, n is a natural number equal to or greater than 2, and it must be set to be a natural number less than the number of bits of the digital video signal DAT.

Also, the fourth decoder 3036 is configured to include the switch that is turned on/off by the bit values of the number of bits corresponding to the size n from among the entire bits included in the digital video signal DAT, that is, 10 bits.

In FIG. 8, FIG. 9, FIG. 10, FIG. 15, FIG. 16, FIG. 17, and FIG. 20, the first to third decoders and the fourth decoder 3036 according to the first and second exemplary embodiments of the present invention are formed to control the turn on/off of the switches that are formed near the resistors. R1 to R1024 in the order from the lowermost bit to the highermost bit from among the input digital data DAT.

The liquid crystal display (LCD) according to the exemplary embodiments of the present invention reduces realization cost and area of the liquid crystal display (LCD) by reducing the number of switches included in the data driver 300.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display (LCD) comprising:

a liquid crystal display panel including a plurality of scan lines for transmitting a plurality of scan signals, a plurality of data lines for transmitting a plurality of data signals, and a plurality of pixels defined by the plurality of scan lines and the plurality of data lines;

a reference gray voltage generator for generating a plurality of reference gray voltages; and a data driver for generating the plurality of data signals by combining $2^k$ voltages that correspond to bit values of (m−k) bits from among m-bit video signals applied from the outside based on the plurality of reference gray voltages and are determined as one of a first gray voltage and a second gray voltage, and applying the plurality of data signals to the plurality of pixels, wherein the data driver includes a digital to analog (D/A) converter including a first decoder to a third decoder, generating a third gray voltage to a fifth gray voltage respectively corresponding to bit values of at least (m−k−2) bits from among the (m−k) bits by using the first to third decoders, and generating the first and second gray voltages by selecting two voltages from among the third to fifth gray voltages, where m is a natural number greater than 3, and k is a natural number less than (m−2).

2. The liquid crystal display (LCD) of claim 1, wherein the digital to analog (D/A) converter further includes:

a selected voltage output unit for selecting two gray voltages corresponding to bit values of two bits from among the (m−k) bits from among the third to fifth gray voltages as the first and second gray voltages, and outputting the same; and an output voltage generator for generating and outputting the $2^k$ voltages by using the first and second gray voltages.

3. The liquid crystal display (LCD) of claim 2, wherein the data driver further includes:

a shift register for shifting a position of an output terminal for outputting an enable signal in synchronization with a data clock signal;

a latch for sequentially selecting an operational area in response to the enable signal output by the shift register, sequentially memorizing the video signal of the selected operational area, and outputting the memorized video signal to the digital to analog (D/A) converter; and an output voltage amplifier for generating the data signal by combining the $2^k$ voltages, and applying the generated data signal to the pixel.

4. The liquid crystal display (LCD) of claim 3, wherein the output voltage amplifier includes:

a first input terminal including $2^k$ first switches being turned on/off when receiving the $2^k$ voltages at each control electrode;

a second input terminal including $2^k$ second switches being turned on/off when receiving the data signal at each control electrode, the second switch having a first terminal coupled to each first terminal of the $2^k$ first switches;

$2^k$ current sources each having one terminal coupled to respective first terminals of the respective $2^k$ first switches and $2^k$ second switches, and other terminals coupled to a first power source for supplying a first voltage that is less than a common voltage; and an output terminal coupled in common to second terminals of the $2^k$ second switches, and outputting the data signal that is generated by combining the $2^k$ voltages to the pixel.

5. A driving device of a liquid crystal display (LCD), comprising:

a reference gray voltage generator for generating a plurality of reference gray voltages; and a data driver for generating a plurality of gray voltages based on the plurality of reference gray voltages, and applying a data signal that is generated by selecting a gray voltage corresponding to m-bit video signals applied from the outside from among the plurality of gray voltages to the pixel, wherein the data driver includes:

a voltage generator for selecting a first gray voltage and a second gray voltage corresponding to bit values of (m−k) bits from among the video signal from among the plurality of gray voltages, and outputting the first and second gray voltages;

an output voltage generator for outputting $2^k$ voltages determined as one of the first and second gray voltages corresponding to bit values of k bits from among the video signal; and an output voltage amplifier for generating the data signal by combining the $2^k$ voltages, and applying the data signal to a plurality of pixels, where m is a natural number greater than 3, and k is a natural number less than (m−2).

6. The driving device of claim 5, wherein the voltage generator includes:

a first decoder to a third decoder for generating a third gray voltage to a fifth gray voltage corresponding to bit values of at least (m−k−2) bits from among the (m−k) bits based on the plurality of reference gray voltages; and a selected voltage output unit for generating the first and second gray voltages by selecting two voltages from among the third to fifth gray voltages.

7. The driving device of claim 6, wherein the first to third decoders generate different gray voltages that are less than ($2^{m-k-1}$) based on the plurality of reference gray voltages, select the third to fifth gray voltages corresponding to bit values of at least (m−k−2) bits from among the gray voltages less than ($2^{m-k-1}$), and output the same.

8. The driving device of claim 7, wherein the first decoder generates $2^{m-k-2}$ gray voltages based on the plurality of reference gray voltages, selects the third gray voltage corresponding to bit values of the (m−k−2) bits from among the $2^{m-k-2}$ gray voltages, and outputs the same, and the second decoder and the third decoder generate less than $2^{m-k-1}$ different gray voltages based on the plurality of reference gray voltages, select the fourth gray voltage and the fifth gray voltage corresponding to bit values of (m−k−1) bits from among the (m−k) bits from among the less than $2^{m-k-1}$ gray voltages, and output the same.

9. The driving device of claim 8, wherein the plurality of reference gray voltages are $2^m$ gray voltages that are generated by a partial pressure by respective $2^{m+1}$ resistors that are coupled in series between a first power source for supplying a common voltage and a second power source for supplying a first voltage that is greater than the common voltage or between the first power source and a third power source for supplying a second voltage that is less than the common voltage, and the $2^{m-k-2}$ gray voltages are gray voltages that have a voltage difference by the voltage applied to $2^{(k+2)}$ resistors from among the $2^{m+1}$ resistors from the third voltage from among the $2^m$ gray voltages.

10. The driving device of claim 9, wherein the gray voltages generated by the second decoder are gray voltages that have a voltage difference by the voltage applied to $2^{(k+1)}$ resistors from among the $2^{m+1}$ resistors from a fourth voltage from among the $2^m$ gray voltages, and a difference between absolute values of the third voltage and the fourth voltage is a voltage applied to $2^k$ resistors from among the $2^{m+1}$ resistors.

11. The driving device of claim 10, wherein the gray voltages generated by the third decoder are gray voltages having a voltage difference by a voltage applied to $2^{(k+1)}$ resistors from among the $2^{m+1}$ resistors from a fifth voltage from among the $2^m$ gray voltages when a bit value of a first bit from among the m−k bits is a first level, the less than $2^{m-k-1}$ gray voltages are gray voltages having a voltage difference by the voltage applied to $2^{(k+1)}$ resistors from among the $2^{m+1}$ resistors from a sixth voltage from among the $2^m$ gray voltages when the bit value of the first bit is a second level, and a difference between absolute values of the fifth voltage and the sixth voltage and a difference between absolute values of the fifth voltage and the fourth voltage are voltages that are respectively applied to $2^{(k+2)}$ resistors and $2^k$ resistors from among the $2^{m+1}$ resistors.

12. The driving device of claim 11, wherein when the absolute value of the fifth voltage is greater than the absolute value of the sixth voltage, the difference between the absolute values of the third voltage and the fifth voltage is the voltage applied to $2^{(k+1)}$ resistors from among the $2^{m+1}$ resistors, and when the absolute value of the fifth voltage is less than the absolute value of the fourth voltage, the difference between the absolute values of the third voltage and the sixth voltage is the voltage applied to $2^{(k+1)}$ resistors from among the $2^{m+1}$ resistors.

13. The driving device of claim 6, wherein the selected voltage output unit selects two gray voltages having low voltages from among the third to fifth gray voltages as the first gray voltage and the second gray voltage when a bit value of one bit from among the m−k bits is a first level, and selects two gray voltages having high voltages from among the third to fifth gray voltages as the first gray voltage and the second gray voltage when a bit value of one bit from among the m−k bits is a second level.

14. The driving device of claim 5, wherein the output voltage generator outputs the n first gray voltages and the $2^{k-n}$ second gray voltages corresponding to a first value that is generated by converting bit values of the k bits into a 10-ary number, and the n is equal to the first value or is generated by adding "1" to the first value.

15. The driving device of claim 5, wherein the output voltage amplifier includes:

a first input terminal including $2^k$ first switches that are turned on/off by receiving the $2^k$ voltages at control electrodes;

a second input terminal including $2^k$ second switches that are turned on/off by receiving the data signal at control electrodes and have first terminals coupled to first terminals of the $2^k$ first switches;

$2^k$ current sources each having one terminal coupled to respective first terminals of the respective $2^k$ first switches and $2^k$ second switches and other terminals coupled to the second power source; and an output terminal coupled in common to second terminals of the $2^k$ second switches, and outputting the data signal that is generated by combining the $2^k$ voltages to the pixel.

16. A digital to analog (D/A) converter for generating a plurality of gray voltages based on a plurality of reference gray voltages, and selecting and outputting a gray voltage corresponding to a digital video signal applied from the outside from among the plurality of gray voltages, the digital to analog (D/A) converter comprising:

a voltage generator for selecting and outputting a first gray voltage and a second gray voltage corresponding to bit values of m−k bits except k bits from among the m-bit digital video signal; and an output voltage generator for outputting $2^k$ voltages determined as one of the first and second gray voltages corresponding to bit values of the k bits from among the digital video signal, where m is a natural number greater than 3 and k is a natural number less than m−2.

17. The D/A converter of claim 16, wherein the voltage generator includes:

a first decoder for generating $2^{m-k-2}$ gray voltages based on the plurality of reference gray voltages, and selecting and outputting a third gray voltage corresponding to bit values of m−k−2 bits from among the m−k bits from among the $2^{m-k-2}$ gray voltages; and a second decoder and a third decoder for generating $2^{m-k-1}$ different gray voltages based on the plurality of reference gray voltages, and selecting and outputting a fourth gray voltage and a fifth gray voltage corresponding to bit values of m−k−1 bits from among the m−k bits from among the $2^{m-k-1}$ gray voltages.

18. A liquid crystal display (LCD) comprising:

a liquid crystal display panel including a plurality of scan lines for transmitting a plurality of scan signals, a plurality of data lines for transmitting a plurality of data signals, and a plurality of pixels defined by the plurality of scan lines and the plurality of data lines;

a reference gray voltage generator for generating a plurality of reference gray voltages; and a data driver for applying the plurality of data signals to the plurality of pixels, the data signals corresponding to a third gray voltage that is generated in correspondence to bit values of n bits from among the plurality of data signals or the video signal generated by combining $2^k$ voltages that correspond to bit values of (m−k) bits from among m-bit video signals applied from the outside based on the plurality of reference gray voltages and are determined to be one of a first gray voltage and a second gray voltage, wherein the data driver includes a digital to analog (D/A) converter for generating the first and second gray voltages or generating the third gray voltage, wherein the D/A converter selects two voltages from among fourth to sixth gray voltages that are generated corresponding to bit values of at least (m−k−2) bits from among the (m−k) bits, where m is a natural number greater than 3, k is a natural number less than m−2, and n is a natural number greater than or equal to 2 and less than m.

19. The liquid crystal display (LCD) of claim 18, wherein the digital to analog (D/A) converter further includes:

a selected voltage output unit for selecting two gray voltages corresponding to bit values of two bits from among the (m−k) bits from among the fourth to sixth gray voltages as the first and second gray voltages, and outputting the same;

an output voltage generator for generating and outputting the $2^k$ voltages by using the first and second gray voltages; and a decoder for generating and outputting a third gray voltage corresponding to bit values of the n bits, and the n bits are not included in the bits less than the (m−k−2) bits.

20. The liquid crystal display (LCD) of claim 19, wherein the data driver further includes:

a shift register for shifting a position of an output terminal for outputting an enable signal in synchronization with a data clock signal;

a latch for sequentially selecting an operational area in response to the enable signal output by the shift register, sequentially memorizing the video signal of the selected operational area, and outputting the memorized video signal to the digital to analog (D/A) converter; and an output voltage amplifier for generating the data signal by combining the $2^k$ voltages, or generating the data signal corresponding to the third gray voltage, and applying the generated data signal to the pixel.

21. The liquid crystal display (LCD) of claim 20, wherein the output voltage amplifier includes:

a first input terminal including $2^k$ first switches being turned on/off when receiving the $2^k$ voltages or the third gray voltage at each control electrode;

a second input terminal including $2^k$ second switches being turned on/off when receiving the data signal at each control electrode, the second switch having a first terminal coupled to each first terminal of the $2^k$ first switches;

$2^k$ current sources each having one terminal coupled to respective first terminals of the respective $2^k$ first switches and $2^k$ second switches, and other terminals coupled to a first power source for supplying a first voltage that is less than a common voltage; and an output terminal coupled in common to second terminals of the $2^k$ second switches, and outputting the data signal that is generated by combining the $2^k$ voltages to the pixel.

22. A driving device of a liquid crystal display (LCD) comprising:

a reference gray voltage generator for generating a plurality of reference gray voltages; and a data driver for generating a plurality of gray voltages based on the plurality of reference gray voltages, and applying a data signal that is generated by selecting a gray voltage corresponding to m-bit video signals applied from the outside from among the plurality of gray voltages to the pixel, wherein the data driver includes:

a voltage generator for selecting a first gray voltage and a second gray voltage corresponding to bit values of (m−k) bits from among the video signal from among the plurality of gray voltages, and outputting the first and second gray voltages;

an output voltage generator for outputting $2^k$ voltages determined as one of the first and second gray voltages corresponding to bit values of k bits from among the video signal;

at least one decoder for generating a third gray voltage corresponding to bit values of at least 2 bits from among the video signal; and an output voltage amplifier for generating the data signal by combining the $2^k$ voltages, or generating the data signal corresponding to the third gray voltage, and applying the data signal to a plurality of pixels, where m is a natural number greater than 3, and k is a natural number less than (m−2).

23. The driving device of claim 22, wherein the at least one decoder and the voltage generator are selectively driven corresponding to the video signal input to the data driver.

24. The driving device of claim 23, wherein the voltage generator includes:

a first decoder to a third decoder for generating a fourth gray voltage to a sixth gray voltage corresponding to bit values of at least (m−k−2) bits from among the (m−k) bits based on the plurality of reference gray voltages; and a selected voltage output unit for generating the first and second gray voltages by selecting two voltages from among the fourth to sixth gray voltages.

25. The driving device of claim 24, wherein the first to third decoders generate different gray voltages that are less than ($2^{m-k-1}$) based on the plurality of reference gray voltages, select the fourth to sixth gray voltages corresponding to bit values of at least (m−k−2) bits from among the gray voltages less than ($2^{m-k-1}$), and output the same.

26. The driving device of claim 25, wherein the first decoder generates $2^{m-k-2}$ gray voltages based on the plurality of reference gray voltages, selects the fourth gray voltage corresponding to bit values of the (m−k−2) bits from among the $2^{m-k-2}$ gray voltages, and outputs the same, and the second decoder and the third decoder generate less than $2^{m-k-1}$ different gray voltages based on the plurality of reference gray voltages, select the fifth gray voltage and the sixth gray voltage corresponding to bit values of (m−k−1) bits from among the (m−k) bits from among the less than $2^{m-k-1}$ gray voltages, and output the same.

27. The driving device of claim 26, wherein the plurality of reference gray voltages are $2^m$ gray voltages that are generated by a partial pressure by respective $2^{m+1}$ resistors that are coupled in series between a first power source for supplying a common voltage and a second power source for supplying a first voltage that is greater than the common voltage or between the first power source and a third power source for supplying a second voltage that is less than the common voltage, and the $2^{m-k-2}$ gray voltages are gray voltages that have a voltage difference by the voltage applied to $2^{(k+2)}$ resistors from among the $2^{m+1}$ resistors from the third voltage from among the $2^m$ gray voltages.

28. The driving device of claim 27, wherein the gray voltages generated by the third decoder are gray voltages that have a voltage difference by the voltage applied to $2^{(k+1)}$ resistors from among the $2^{m+1}$ resistors from a fourth voltage from among the $2^m$ gray voltages, and a difference between absolute values of the third voltage and the fourth voltage is a voltage applied to $2^k$ resistors from among the $2^{m+1}$ resistors.

29. The driving device of claim 28, wherein the gray voltages generated by the third decoder are gray voltages having a voltage difference by a voltage applied to $2^{(k+1)}$ resistors from among the $2^{m+1}$ resistors from a fifth voltage from among the $2^m$ gray voltages when a bit value of a first bit from among the m−k bits is a first level, the less than $2^{m-k-1}$ gray voltages are gray voltages having a voltage difference by the voltage applied to $2^{(k+1)}$ resistors from among the $2^{m+1}$ resistors from a sixth voltage from among the $2^m$ gray voltages when the bit value of the first bit is a second level, and a difference between absolute values of the fifth voltage and the sixth voltage and a difference between absolute values of the fifth voltage and the fourth voltage are voltages that are respectively applied to $2^{(k+2)}$ resistors and $2^k$ resistors from among the $2^{m+1}$ resistors.

30. The driving device of claim 29, wherein when the absolute value of the fifth voltage is greater than the absolute value of the sixth voltage, the difference between the absolute values of the third voltage and the fifth voltage is the voltage applied to $2^{(k+1)}$ resistors from among the $2^{m+1}$ resistors, and when the absolute value of the fifth voltage is less than the absolute value of the fourth voltage, the difference between the absolute values of the third voltage and the sixth voltage is the voltage applied to $2^{(k+1)}$ resistors from among the $2^{m+1}$ resistors.

31. The driving device of claim 24, wherein the selected voltage output unit selects two gray voltages having low voltages from among the fourth to sixth gray voltages as the first gray voltage and the second gray voltage when a bit value of one bit from among the m−k bits is a first level, and it selects two gray voltages having high voltages from among the fourth to sixth gray voltages as the first gray voltage and the second gray voltage when a bit value of one bit from among the m−k bits is a second level.

32. The driving device of claim 22, wherein the output voltage generator outputs the n first gray voltages and the $2^{k-n}$ second gray voltages corresponding to a first value that is generated by converting bit values of the k bits into a 10-ary number, and the n is equal to the first value or is generated by adding "1" to the first value.

33. The driving device of claim 22, wherein the output voltage amplifier includes:

a first input terminal including $2^k$ first switches that are turned on/off by receiving the $2^k$ voltages or the third gray voltage at control electrodes;

a second input terminal including $2^k$ second switches that are turned on/off by receiving the data signal at control electrodes and have first terminals coupled to first terminals of the $2^k$ first switches;

$2^k$ current sources each having one terminal coupled to respective first terminals of the respective $2^k$ first switches and $2^k$ second switches and other terminals coupled to the second power source; and an output terminal coupled in common to second terminals of the $2^k$ second switches, and outputting the data signal that is generated by combining the $2^k$ voltages to the pixel.

* * * * *